United States Patent [19]

Squassoni et al.

[11] 4,006,982

[45] Feb. 8, 1977

[54] PHOTOELECTROPHORETIC CONCURRENT PROCESS CYCLING

[75] Inventors: Gino F. Squassoni, Pittsford; Earl V. Jackson, Penfield, both of N.Y.

[73] Assignee: Xerox Corporation, Stamford, Conn.

[22] Filed: Apr. 24, 1975

[21] Appl. No.: 571,326

[52] U.S. Cl. ..... 355/3 P; 355/14

[51] Int. Cl.[2] ..... G03G 15/00

[58] Field of Search ..... 355/14, 3 P, 4, 17; 204/181 PE, 300 PE; 96/1 PE, 1.3

[56] References Cited

UNITED STATES PATENTS

| | | | |
|---|---|---|---|
| 3,503,677 | 3/1970 | Uchiyama | 355/13 |
| 3,616,390 | 10/1971 | Weigl | 96/1.3 X |
| 3,697,409 | 10/1972 | Weigl | 96/1 PE |
| 3,700,326 | 10/1972 | Murgas et al. | 355/14 |
| 3,702,289 | 11/1972 | Egnaczak | 204/181 PE |
| 3,869,202 | 3/1975 | Tabata | 355/14 X |
| 3,900,256 | 8/1975 | Ravera et al. | 355/14 |

*Primary Examiner*—R. L. Moses

*Attorney, Agent, or Firm*—James J. Ralabate; Michael H. Shanahan; Charles E. Smith

[57] ABSTRACT

A photoelectrophoretic imaging machine for producing, in a preferred embodiment, full color copies from opaque originals or, alternatively, copies from transparencies. station passing the sandwich In a preferred embodiment, the formation of photoelectrophoretic images occurs between two thin injecting and blocking webs at least one of which is partially transparent and the image formed is transferred to a paper web. The injecting and blocking webs may be disposable, thus, cleaning systems are not required. The injecting web is provided with a conductive surface and is driven in a path to the inking station where a layer of photoelectrophoretic ink is applied to the conductive web surface. The inked injecting web is driven in a path passing a deposition scorotron at the precharge station and into contact with the blocking web to form the ink-web sandwich at the imaging roller in the imaging zone. The conductive surface of the injecting web is grounded and a high voltage is applied to the imaging roller subjecting the sandwich to a high electric field at the same time as the scanning optical image is focused on the nip or interface between the injecting and blocking webs, and development takes place. The photoelectrophoretic image is carried by the injecting web to the transfer zone, into contact with the paper web at the transfer roller where the image is transferred to the paper web giving the final copy. In one preferred embodiment, machine components and subsystems are arranged and operated to accomplish the process steps of inking, imaging and transfer concurrently.

10 Claims, 31 Drawing Figures

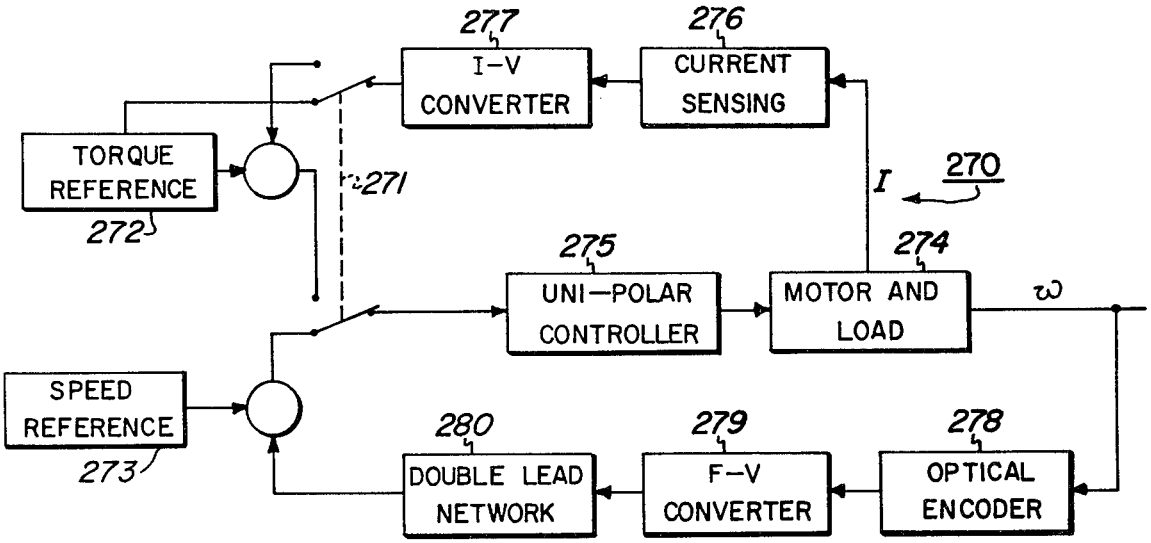
FIG. 19
FIG. 20
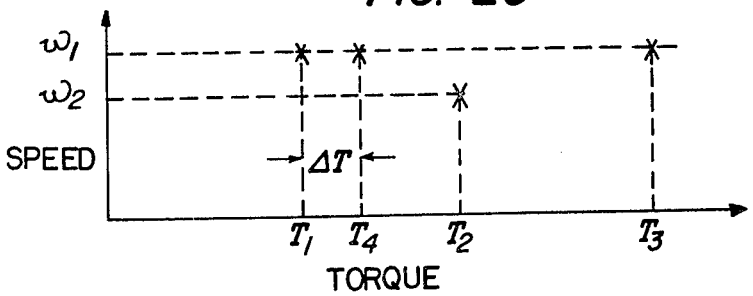

PHOTOELECTROPHORETIC CONCURRENT PROCESS CYCLING

BACKGROUND OF THE INVENTION

This invention relates in general to photoelectrophoretic imaging machines and, more particularly, an improved web device color copier photoelectrophoretic imaging machine.

In the photoelectrophoretic imaging process, monochromatic including black and white or full color images are formed through the use of photoelectrophoresis. An extensive and detailed description of the photoelectrophoretic process is found in U.S. Pat. Nos. 3,348,488 and 3,383,565 to Tulagin and Carreira; 3,383,993 to Yeh and 3,384,566 to Clark, which disclose a system where photoelectrophoretic particles migrate in image configuration providing a visible image at one or both of two electrodes between which the particles suspended within an insulating carrier is placed. The particles are electrically photosensitive and are believed to bear a net electrical charge while suspended which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic depending upon whether the photosensitive particles within the liquid carrier are responsive to the same or different portions of the light spectrum. A full-color polychromatic system is obtained, for example, by using cyan, magenta and yellow colored particles which are responsive to red, green and blue light respectively.

In photoelectrophoretic imaging generally, and as employed in the instant invention, the important broad teachings in the following five paragraphs should be noted.

Preferably, as taught in the four patents referred to above, the electric field across the imaging suspension is applied between electrodes having certain preferred properties, i.e., an injecting electrode and blocking electrode, and the exposure to activating radiation occurs simultaneously with field application. However, as taught in various of the four patents referred to above and Luebbe et al. U.S. Pat. No. 3,595,770; Keller et al. U.S. Pat. No. 3,647,659 and Carreira et al, U.S. Pat. No. 3,477,934, such a wide variety of materials and modes for associating an electrical bias therewith, e.g., charged insulating webs, may serve as the electrodes, i.e., the means for applying the electric field across the imaging suspension, that opposed electrodes generally can be used; and that exposure and electrical field applying steps may be sequential. In preferred embodiments herein, one electrode may be referred to as the injecting electrode and the opposite electrode as the blocking electrode. This is a preferred embodiment description. The terms blocking electrode and injecting electrode should be understood and interpreted in the context of the above comments throughout the specification and claims hereof.

It should also be noted that any suitable electrically photosensitive particles may be used. Kaprelian, U.S. Pat. No. 2,940,847 and Yeh, U.S. Pat. No. 3,681,064 disclose various electrically photosensitive particles, as do the four patents first referred to above.

In a preferred mode, at least one of the electrodes is transparent, which also encompasses partial transparency that is sufficient to pass enough electromagnetic radiation to cause photoelectrophoretic imaging. However, as described in Weigl, U.S. Pat. No. 3,616,390, both electrodes may be opaque.

Preferably, the injecting electrode is grounded and a suitable source of difference of potential between injecting and blocking electrodes is used to provide the field for imaging. However, such a wide variety of variations in how the field may be applied can be used, including grounding the blocking electrode and biasing the injecting electrode, biasing both electrodes with different bias values of the same polarity, biasing one electrode at one polarity and biasing the other at the opposite polarity of the same or different values, that just applying sufficient field for imaging can be used.

The photoelectrophoretic imaging system disclosed in the above-identified patents may utilize a wide variety of electrode configurations including a transparent flat electrode configuration for one of the electrodes, a flat plate or roller for the other electrode used in establishing the electric field across the imaging suspension.

The photoelectrophoretic imaging system of this invention utilizes web materials, which optimally may be disposable. In this system, the desired, e.g., positive image, is formed on one of the webs and another web will carry away the negative or unwanted image. The positive image can be fixed to the web upon which it is formed or the image transferred to a suitable backing such as paper. The web which carries the negative image can be rewound and later disposed of. In ths successive color copier photoelectrophoretic imaging system employing consumable webs, cleaning systems are not required.

Web machine patents may be found in the photoelectrophoretic, electrophotography, electrophoresis and coating arts. In the photoelectrophoresis area is Mihajlov U.S. Pat. No. 3,427,242. This patent discloses continuous photoelectrophoretic apparatus but using rotary drums for the injectng and blocking electrodes instead of webs. The patent to Mihajlov also suggests the elimination of cleaning apparatus by passing a web substrate between the two solid rotary injecting and blocking electrodes. U.S. Pat. No. 3,586,615 to Carreira suggests that the blocking electrode may be in the form of a continuous belt. U.S. Pat. No. 3,719,484 to Egnaczak discloses continuous photoelectrophoretic imaging process utilizing a closed loop conductive web as the blocking electrode in conjunction with a rotary drum injecting electrode. This system uses a continuous web cleaning system but suggests consumable webs in place of disclosed continuous webs to eliminate the necessity for cleaning apparatus. U.S. Pat. No. 3,697,409 to Weigl discloses photoelectrophoretic imaging using a closed loop or continuous injecting web in direct contact with a roller electrode and suggests that the injecting web may also be wound between two spools. U.S. Pat. No. 3,679,408 discloses photoelectrophoretic imaging using a single web but only one solid piece. Pat. No. 3,702,289 discloses the use of two webs but two solid surfaces. U.S. Pat. No. 3,477,934 to Carreira discloses that a sheet of insulating material may be arranged on the injecting electrode during photoelectrophoretic imaging. The insulating material may comprise, inter alia, baryta paper, cellulose acetate or polyethylene coated papers. Exposure may be made through the injecting electrode or blocking electrode.

U.S. Pat. No. 3,664,941 to Jelfo teaches that bond paper may be attached to the blocking electrode during imaging and that exposure could be through the blocking electrode where it is optically transparent. This patent further teaches that the image may be formed on a removable paper substrate or sleeve superimposed or wrapped around a blocking electrode or otherwise in the position between the electrode at the site of otherwise in the position between the electrode at the site of imaging.

U.S. Pat. No. 3,772,013 to Wells discloses a photelectrophoretic stimulated imaging process and teaches that a paper sheet may comprise the insulating film for one of the electrodes and also discloses that exposure may be made through this electrode. This insulating film may be removed from the apparatus and the image fused thereto.

U.S. Pat. Nos. 3,761,174 and 3,642,363 to Davidson disclose apparatus for effecting the manifold imaging process wherein an image is formed by the selective transfer of a layer of imaging material sandwiched between donor and receiver webs.

U.S. Pat. No. 2,376,922 to King; 3,166,420 to Clark; 3,182,591 to Carlson and 3,598,597 to Robinson are patents representative of web machines found mostly in the general realm of electrophotography. These patents disclose the broad concept of bringing two webs together, applying a light image thereto at the point of contact and by the application of an electric field effecting a selective imagewise transfer of toner from one web to the other.

SUMMARY OF THE INVENTION

It is an object of this invention to provide an improved photoelectrophoretic imaging machine employing the use of disposable webs.

Another object of this invention is to provide a photoelectrophoretic imaging machine which does not require the use of complex cleaning systems.

Another object of the present invention is to provide a photoelectrophoretic imaging machine capable of utilizing both opaque and transparent inputs.

Still another object of this invention is to provide a photoelectrophoretic imaging machine designed to provide maximum flexibility for changes in process configuration and not thereby unduly upset the remaining portions of the machine.

Yet another object of the present invention is to provide a photoelectrophoretic imaging device designed so that two webs are driven in synchronism at the imaging and transfer stations.

Still a further object of this invention is to provide a photoelectrophoretic imaging machine in which fresh web surfaces are used for each image.

These and other objects of this invention are accomplished by the use of a photoelectrophoretc imaging machine for producing, in a preferred embodiment, full color copies from opaque originals or, alternatively, copies from transparencies.

In a preferred embodiment, the formation of photoelectrophoretic images occur between two thin injecting and blocking webs at least one of which is partially transparent and the image formed is transferred to a paper web. The injecting and blocking webs may be disposable, thus, cleaning systems are not required. The injecting web is providing with a conductive surface and is driven in a path to the inking station where a layer of photoelectrophoretic ink is applied to the conductive web surface. The inked injecting web is driven in a path passing in close proximity to the deposition scorotron at the precharge station and into contact with the blocking web to form the ink-web sandwich at the imaging roller in the imaging zone. The conductive surface of the injecting web is grounded and a high voltage is applied to the imaging roller subjecting the sandwich to a high electric field at the same time as the scanning optical image is focussed on the nip or interface between the injecting and blocking webs, and developmennt takes place. The photoelectrophoretic image is carried by the injecting web to the transfer zone, into contact with the paper web at the transfer roller where the image is transferred to the paper web giving the final copy. In one preferred embodiment, machine components and subsystems are arranged and operated to accomplish the process of inking, imaging and transfer concurrently.

BRIEF DESCRIPTION OF THE DRAWINGS

These and other objects and advantages will become apparent to those skilled in the art after reading the following description taken in conjunction with the accompanying drawings wherein:

FIG. 19 shows a schematic block diagram for the servo control drive systems for the blocking and paper webs;

FIG. 20 shows the speed-torque curve for the blocking and paper webs drive systems;

FIG.. 27 is a circuit diagram for events which begin and end in the same 360° cycle.

Figure 28:
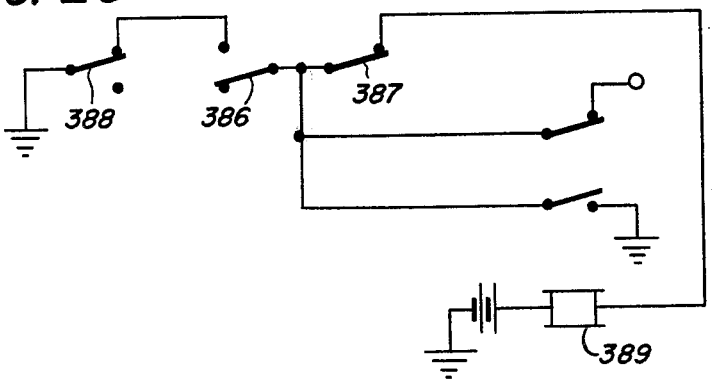

FIG. 28 is a circuit diagram for events which begin and end in different 360° cycles.

DESCRIPTION OF THE PREFERRED EMBODIMENTS

The invention herein is described and illustrated in specific embodiments having specific components listed for carrying out the functions of the apparatus. Nevertheless, the invention need not be thought as being confined to such specific showings and should be construed broadly within the scope of the claims. Any and all equivalent structures known to those skilled in the art can be substituted for specific apparatus disclosed as long as the substituted apparatus achieves a similar function. It may be that systems other than photoelectrophoretic imaging systems will be invented wherein the apparatus described and claimed herein can be advantageously employed and such other uses are intended to be encompassed in this invention as described and claimed herein.

THE PHOTOELECTROPHORETIC WEB DEVICE MACHINE

Figure 1:
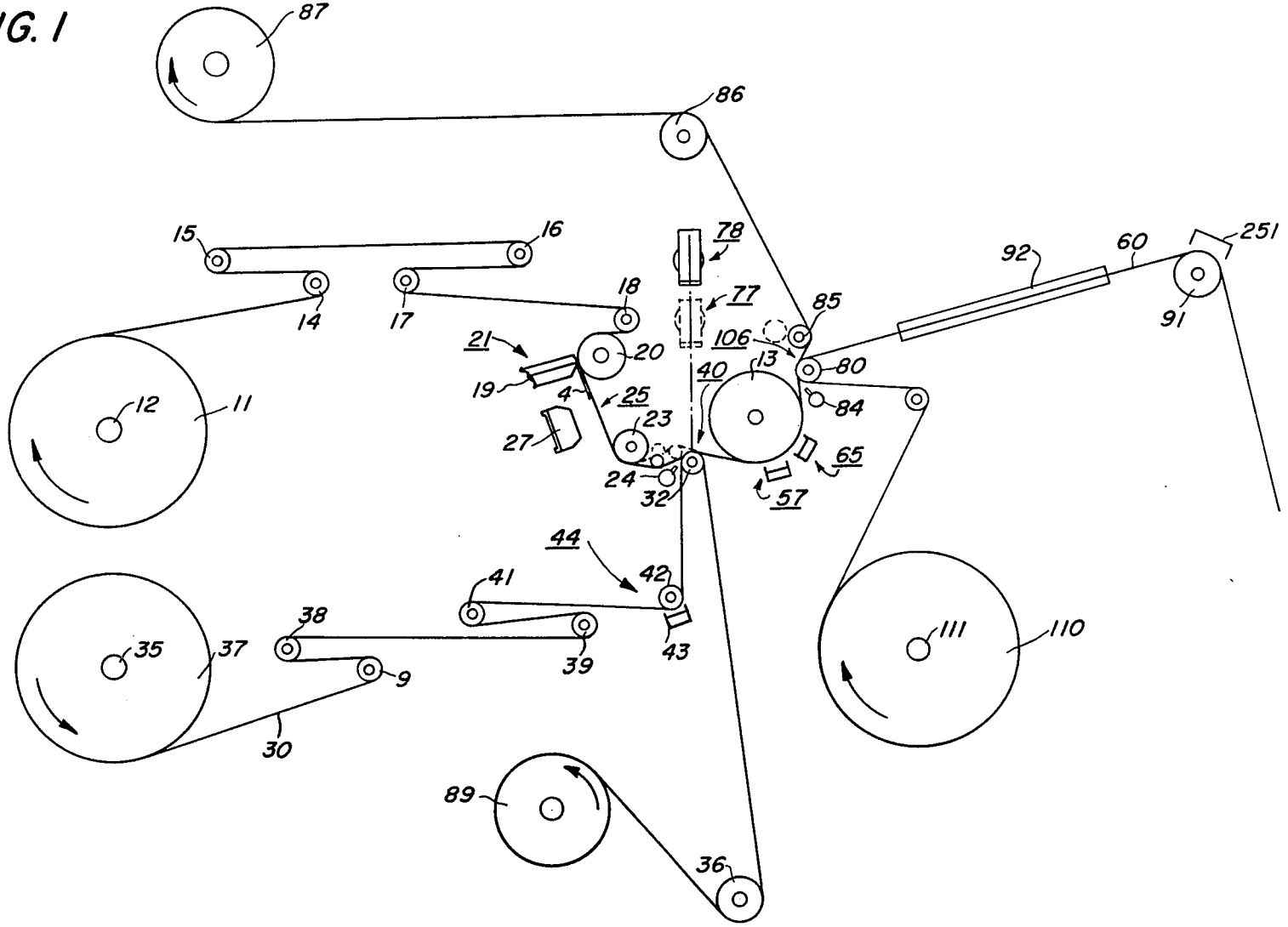
FIG. 1 is a simplified layout, side view, partially schematic diagram of a preferred embodiment of the web device photoelectrophoretic imaging machine according to this invention.

The FIG. 1 shows a simplified layout, side view, partially schematic diagram of the preferred embodiment of the web device color copier photoelectrophoretic imaging machine 1, according to this invention. Three flexible thin webs, the injecting web 10, the blocking web 30, which may be consumable, and the paper web 60 are employed to effect the basic photoelectrophoretic imaging process.

The photoelectrophoretic imaging process is carried out between the flexible injecting and blocking webs. The conductive or injecting web 10 is analogous to the injecting electrode described in earlier basic photoelectrophoretic imaging systems. The injecting web 10 is initially contained on the prewound conductive web supply roll 11, mounted for rotation about the axis 12 in the direction of the arrow. The conductive web 10 may be formed of any suitable flexible transparent or semi-transparent material. In one preferred embodiment, the conductive web is formed of an about 1 mil Mylar, a polyethylene terephthalate polyester film from DuPont, overcoated with a thin transparent conductive material, e.g., about 50% white light transmissive layer of aluminum. When the injecting web 10 takes this construction, the conductive surface is preferably connected to a suitable ground at the imaging roller or at some other convenient roller located in the web path. The bias potential applied to the conductive web surface is maintained at a relatively low value. Methods for biasing the conductive web will be explained in more particularity hereinlater. Also, by proper choice of conductor material, programmed voltage application could be used resulting in the elimination of defects caused by lead edge breakdown. The term "lead edge breakdown", as used herein, refers to a latent image defect which manifests itself in the form of a series of dark wide bands at the lead edge of a copy. Lead edge breakdown defects are believed to be caused by electrical air breakdown on air ionization at the entrance to the imaging zone.

From the conductive web supply 11, the conductive web 10 is driven by the capstan drive roller 13 to the tension rollers 14, 15, 16 and 17. The web 10 is drive from the tensioner rollers around the idler roller 18 and to the inker 19 and backup roller 20 at the inking station generally represented as 21.

The inker 19 is utilized to apply a controlled quantity of photoelectrophoretic ink or imaging suspension 4 to the conductive surface of the injecting web 10 of the desired thickness and length. Any suitable inker capable of applying ink to the required thickness and uniformity across the width of the web may be used. For example, the applicator described in copending application Ser. No. 444,942 entitled "Coating Apparatus and Uses Thereof", filed Feb. 22, 1974, may be adapted for use herein. Another example of an inker that may be adapted for use herein is the inker mechanisms described in U.S. Pat. No. 3,800,743, issued Apr. 2, 1974, by Raymond K. Egnaczak.

From the inking station 21, the conductive web 10 is driven in a path passing in close proximity to the precharged station generally represented as 25. The precharge station 25 will be described more fully hereinafter.

When the conductive web 10, which now contains the coated ink film 4, exits the precharge station 25, the conductive web 10 is driven in a path around the idler roller 23 toward the imaging roller 32 in the imaging zone 40. The blocking web 30, which is analogous to the blocking electrode described in earlier photoelectrophoretic imaging systems, is initially contained on the prewound blocking web supply roll 37 mounted for rotation about the axis 35 in the direction of the arrow. The blocking web 30 is driven from the supply roll 37 by the capstan drive roller 36 in the path around the tension rollers 9, 38, 39 and 41 to the roller 42 and corotron 43 at the blocking web charge station generally represented as 44. The blocking web charge station will be described in more particularity hereinafter.

The blocking web 30 may be formed of any suitable blocking electrode dielectric material. In one preferred embodiment, the blocking web 30 may be formed of a polypropylene blocking electrode material which, as received from the vendor on the prewound supply roll 37, may be laden with random static charge patterns.

These random static charge patterns have been found to vary in intensity from 0 to ±300 volts, and can cause defects in the final image copy. The blocking web charge station 44, as will be explained more fully hereinafter, may be utilized to remove the random static charge patterns or at least dampen the randomness thereof, from the polypropylene blocking web material.

Still referring mainly to FIG. 1, the conductive web 10 and blocking web 30 are driven together into contact with each other at the imaging roller 32. When the ink film 4, on the conductive web 10, reaches the imaging roller 32, the ink-web sandwich is formed and is, thereby, ready for the imaging-development step to take place. The imaging step also comprises deposition and electrophoretic deagglomeration or ink splitting processes. Although the steps of "deposition", "electrophoretic deagglomeration" and "imaging" are referred to herein as being separate and distinct process steps in actuality, there is undoubtedly some overlap of the spatial and temporal intervals during which these three phenomena occur within the "nip" region. The term nip, as used herein, refers to that area proximate the imaging roller 32 where the conductive web 10 and blocking web 30 are in close contact with each other and the ink-web sandwich is formed in the imaging zone 40. The term imaging zone, as used herein, is defined as the area in which the conductive and blocking webs contact to form the nip where the optical image is focussed and exposure and imaging take place.

During the portion of the imaging step when the conductive web 10 and blocking web 30 are in contact, imaging suspension sandwiched between them at the imaging roller 32, the scanning optical image of an original is focussed between the webs. Exposure of the image is accomplished at the same time as the high voltage is being applied to the imaging roller. The photoelectrophoretic imaging machine of ths invention is capable of accepting either transparency inputs from the transparency optical assembly designated as 77 or opaque originals from the opaque optical assembly represented as 78. The transparency and optical assemblies will be described in more particularity hereinafter.

When the conductive and blocking webs are brought together and the layer of ink film 4 reaches the imaging zone 40 to form the ink-web sandwich, the imaging roller 32 is utilized to apply a uniform electrical imaging field across the ink-web sandwich. The combination of the pressure exerted by the tension of the injecting web and the electrical field across the ink-web sandwich at the imaging roller 32 may tend to restrict passage of the liquid suspension, forming a liquid bead at the inlet to the imaging nip. This bead will remain in the inlet to the nip after the coated portion of the web has passed, and will then gradually dissipate through the nip. If a portion of the bead remains in the nip until the subsequent ink film arrives, it will mix with this film and degrade the subsequent images. In one preferred embodiment of this invention, liquid control means is employed to dissipate excess liquid accumulations, if any, at the entrance nip. The liquid control means will be described in detail hereinlater.

While although the field for imaging is preferably established by the use of a grounded conductive web in conjunction with an imaging roller, a non-conductive web pair in conjunction with a roller and corona device may be utilized to establish the electrical field for imaging. In the non-conductive web and corona source embodiment, the imaging roller 32 may be grounded in order to obtain the necessary field for imaging.

Still referring mainly to FIG. 1, after the process steps of pigment discharge at the discharge station 57 and recharge at the recharge station 65 (or optionally, only recharge) the conductive web 10 carries the image into the transfer zone 106 into contact with the paper web 60 to form the image-web sandwich, and the transfer step is accomplished. When the conventional electrostatic transfer method is used, the copy or paper web 60 may be in the form of any suitable paper. The paper web 60 is initially contained on the paper web supply roll 110 and is mounted for rotation about the shaft 111 in the direction of the arrow.

The photoelectrophoretic image on the conductive web 10, approaching the transfer zone 106, may include oil and pigment outside the actual copy format area and may also include excess liquid bead at the trailing edge. When the transfer step is completed, the conductive-transfer web separator roller 85 is moved to the standby position indicated by the dotted outline. This separates the conductive web 10 and paper web 60 briefly, to allow the excess liquid bead to pass the transfer zone 106 before the separator roller 85 is moved to its original position bringing the webs back into contact. A more particular description of the transfer zone will follow.

The conductive web 10 is transported by drive means away from the transfer zone 106 around the capstan roller 86 to the conductive web takeup or rewind roll 87. When the conductive web is completely rewound onto the takeup roll 87, it may be disposed of. In an alternative embodiment, the takeup roll 87 may be substituted for by an electrostatic tensioning device and the image on the web saved for observation or examination. The electrostatic tensioning device will be described in more particularity hereinafter.

The blocking web 30, which contains the negative image after the imaging step is transported by drive means around the capstan roller 36 to the blocking web takeup or rewind roll 89. When the blocking web is completely rewound onto the takeup roll 89, it may be removed from the machine and disposed of. The paper web 60 is initially contained on the paper web supply roll 110 and is transported by drive means to the transfer zone 106 and, therefrom, to fixing station 92 and around capstan roller 91. The machine web drive system for the conductive, blocking and paper webs will be described in more detail hereinafter.

Figure 2:
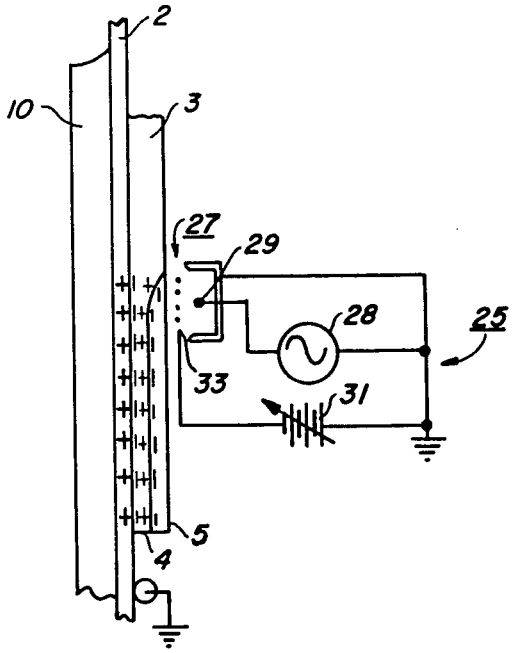
FIG. 2 is a side view, partially schematic diagram of the photoelectrophoretic imaging machine precharge station.

Referring now to FIG. 2, there is shown a side view, partially schematic diagram for illustrating operation of the machine precharge station 25 whereat a uniform charge is applied to the ink film by the scorotron device. Any suitable conventional corona charging device may be used. The scorotron 27 is preferred, however, because with this type of charging unit a charge of uniform potential, rather than uniform charge density, is applied to the ink film. The coated conductive web passes from the inker station to the scorotron assembly 27 at the precharge station 25 where a uniform charge is applied. The inking or backup roller and idler roller cooperate to guide the injecting web 10 in a path passing in close proximity of the deposition scorotron assembly 27 at the precharge station 25. The precharge station, in the direction of travel of the web 10, is located in advance of the imaging station or zone 40, and is used to accomplish the "dark deposition" step. The term dark deposition as used herein, may be defined as the process of depositing all of the pigment particles onto the injecting web 10 and conductive surface 2 precisely where they were coated. Dark deposition is accomplished herein by passing the ink film 3 in the vicinity of the scorotron assembly 27 in the dark, i.e., in the absence of visible radiation. A complete description of the dark charge process is found in U.S. Patent No. 3,477,934 to Carreira et al.

Still referring to FIG. 2, the balanced A.C. electrical potential source 28 is used to couple an A.C. voltage to the coronode 29, and the D.C. voltage source 31 is used to apply a negative voltage to the scorotron shield or screen 33. The electrostatic charge placed upon the ink film or imaging suspension 3 by scorotron 27, while optional can be quite important to the overall characteristics of the final image. For example, process speed, color balance and image defects are affected.

Figure 3:
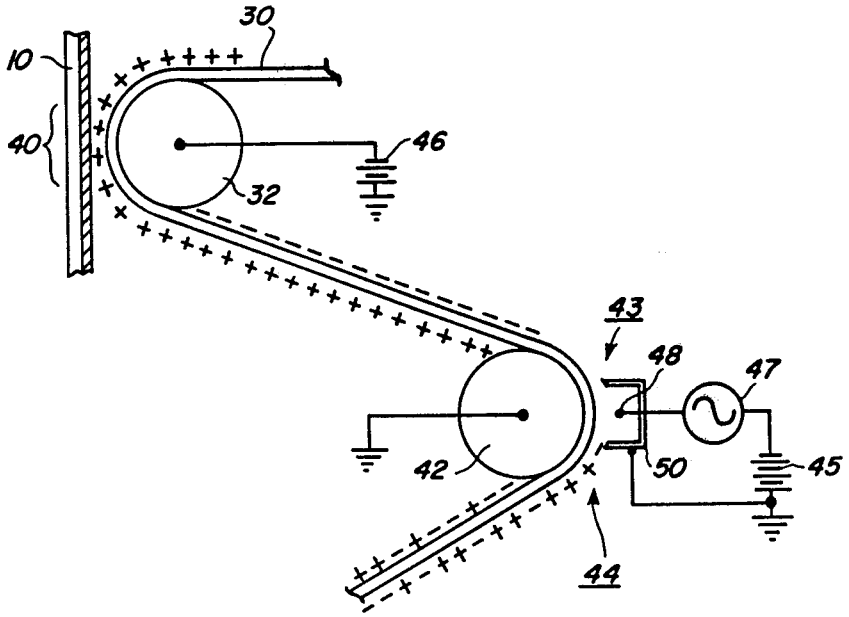
FIG. 3 is a side view, partially schematic diagram illustrating the blocking web charging station.

Turning now to FIG. 3, there is shown a side view, partially schematic diagram illustrating the blocking web charging station. The blocking web charging station 44 is used to eliminate random charge pattern defects. In order to eliminate defects which may be caused by random static charge pattern in polypropylene blocking web material, a bias charge of about -200 volts is applied to the blocking web 30 before entering the imaging zone by the charge corotron 43 at the grounded charge roller 42. Charging the blocking web 30 with the corotron 43 eliminates the random static charge patterns and charges it to a uniform electrostatic charge potential. For example, a positive (+) charge may be provided on the imaging side of the blocking web and a negative (−) charge on the non-imaging side of the blocking web 30. Charged in this manner, the imaging surface of the blocking web 30 does not act as a donor of electrons to the ink coating during the imaging step. It will be appreciated that charges of either polarity may be used in the system to eliminate random static charge pattern.

Still referring to FIG. 3, the corotron 43 is positioned at the charge station 44 to apply a negative electrostatic charge potential to the non-imaging side of the blocking web 30, thereby opposing the imaging D.C. potential 46 coupled to the core of the imaging roller 32. The A.C. potential source 47 is used to couple an A.C. voltage to the coronode 48 and the D.C. voltage source 45 is used to bias the A.C. source.

Figure 4:
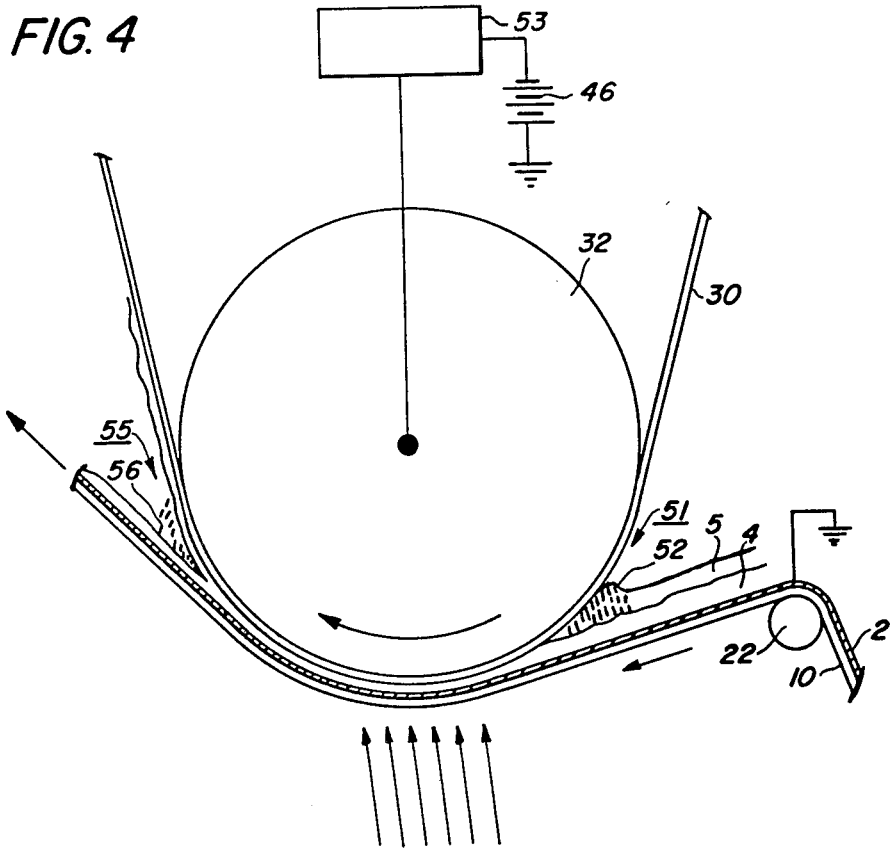
FIG. 4 shows a side view, partially schematic diagram of a detail of the imaging station.

Turning now to FIG. 4, there is shown a side view, partially shcematic diagram of a detail of the imaging station 40. The deposited ink film layer or pigment 4 carried on the electrically grounded conductive web 10 approaches the imaging zone nip entrance 51 with an optimum charge potential, say for example, about -60 volt charge potential. The pigment particles in the ink layer are tacked in place to the conductive surface 2 of the web 10 and the mineral oil 5 is on top of the pigment layer 4 surface. The total ink layer thickness in the nip obtained for typical operating conditions is approximately 8 microns, 2 microns for mineral oil layer 5 and 6 microns for pigment layer 4.

Another method which can be utilized for eliminating air breakdown at the entrance to the imaging zone is to ramp the image voltage turn-on-time. In this case, when the ink layer enters the entrance to the imaging zone, the imaging voltage 46 is programmed linearly by the ramping means 53 from its initial low value (even 0) up to the desired imaging voltage. During this process, the bead of oil 52 is building up in the entrance 51 to the imaging zone. In the web machine, the pressure in the nip is mostly electrostatic in nature. The linear voltage ramp process on the web machine provides a means for building up electrostatic pressure to squeeze out the bead of liquid while keeping the voltage below the level which causes air breakdown.

Still referring to FIG. 4, the deposited photoelectrophoretic image which is carried on the conductive web 10 out of the imaging zone exit gap 55, may be subjected to "negative corona" 56, and thereby cause air breakdown at the exit gap 55. Air breakdown at the imaging zone exit gap 55 may occur whenever the electric field across the air spaces between the pigment particles (and electrodes) exceed the Paschen breakdown voltage. This results in a fine line or bar pattern of high and low charge in the image, perpendicular to the direction of web motion, which usually is not evident until the image is electrostatically transferred to a copy sheet and the charge pattern is developed.

Figure 5:
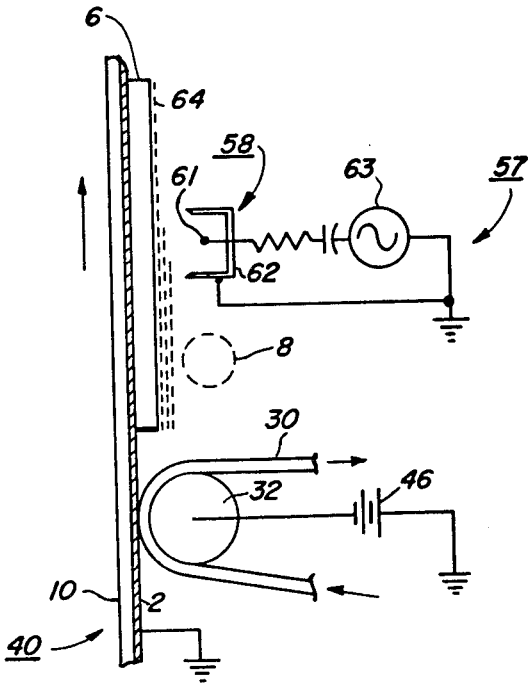
FIG. 5 illustrates a side view, partially schematic diagram of the pigment discharge station.

Turning now to the FIG. 5, there is shown a side view, partially schematic diagram of a preferred embodiment of a method for eliminating image defects resulting from air breakdown at the imaging zone exit gap. The pigment discharge station, designated as 57, while optional, may be used to blot out or neutralize the air breakdown charge pattern generated at the imaging zone exit gap.

The A.C. corotron assembly 58 is employed just beyond the exit of the imaging zone 40 and may be used to discharge the deposited image, thereby eliminating the fine line charge pattern. The corotron coronode 61 is closely spaced from the conductive web 10 surface and the corotron shield 62 is grounded in a suitable manner. The balanced A.C. potential source 63 is coupled to the coronode 61 via the RC series circuit. In one exemplary embodiment, the discharge current produced by the corotron 58 is about 8 microamps per inch at a conductive web velocity of about 5 inches per second. The charge pattern average potential on the pigment layer 6, exiting the imaging zone 40, range in values from about -100 to −200 volts D.C., depending upon the ink film thickness, conductive web velocity and the applied image voltage. After the pigment discharging step at the pigment discharging station 57, the average charge potential 64 falls below about −35 volts D.C. The results are that the transferred image is free of the bar pattern. Also, maintaining a uniform and constant charge level on the photoelectrophoretic image prior to transfer facilitates better control of the transfer process step.

Still referring to the FIG. 5, in an alternative embodiment, the fine line charge pattern may be eliminated by the ultraviolet (U.V.) radiation source 8. In this embodiment, the U.V. radiation source 8 (having a wavelength shorter than wavelengths of visible light) is substituted in place of the A.C. corotron assembly 58 to discharge unwanted charge pattern.

At low charge potentials, say below about −35 volts, the transferred image may suffer from unsharpness due to pigment "running". To achieve a more optimum transfer, the deposited photoelectrophoretic image 6 may be recharged prior to entering the transfer zone.

Figure 6:
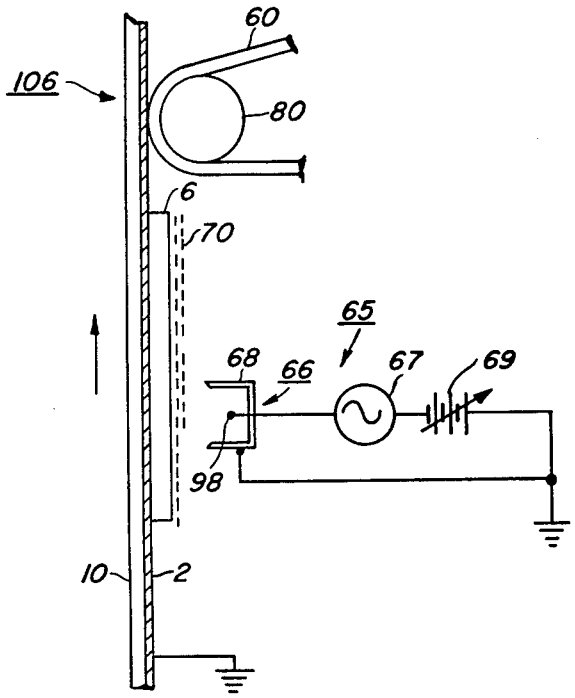
FIG. 6 is a side view, partially schematic diagram of the pigment recharge station of FIG. 5.

Referring now to FIG. 6, there is illustrated a side view, partially schematic diagram of the pigment recharge station generally represented as 65, located in the direction of travel of the conductive web 10 before the transfer zone represented as 106. The negatively biased A.C. corotron 66 is employed prior to the transfer zone to recharge the image 6 carried out of the discharging station on the conductive web 10. The corotron coronode 98 is spaced from the surface of the conductive web 10 and is coupled to the A.C. potential source 67. The corotron shield 68 is grounded. The A.C. potential source 67 is negatively biased by the variable D.C. voltage source 69. In one exemplary embodiment, the recharge currents are nominally about 10 micron-amps per inch, RMS, for the A.C. component and about −5 micro-amps per inch for the average D.C. component with a bias settng of about -1.0 KV and the conductive web velocity of about 5 inches per second. Typically, these parameters produce an optimum recharge potential at 70 of about −65 volts D.C. on the deposited pigment layer 6 when using photoelectrophoretic ink of particular characteristics.

Figure 7:
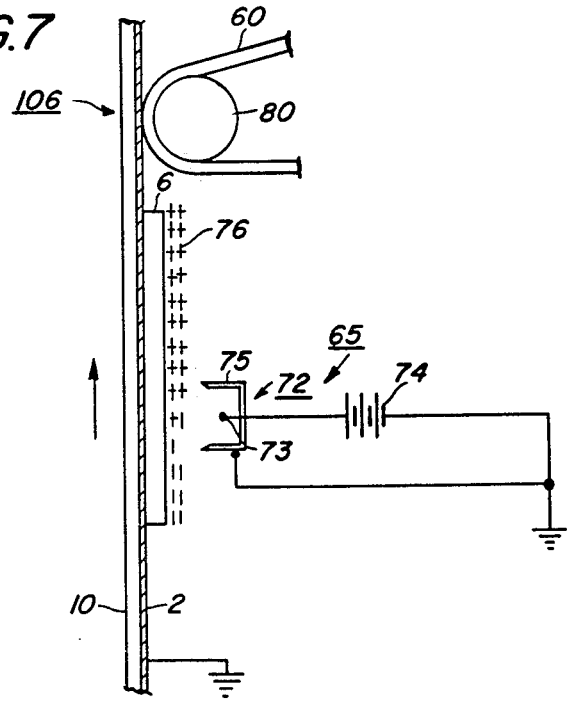
FIG. 7 is a side view of an alternative embodiment for the pigment recharge station of FIG. 6.

Turning now to FIG. 7, there is shown a side view, partially schematic diagram of a preferred alternative embodiment for the pigment recharge station. In the FIG. 7 embodiment, the pigment recharge station 65 uses the positive D.C. corotron 72 prior to the transfer zone 106, to recharge the deposited photoelectrophoretic image 6. The corotron coronode 73 is spaced closely from the surface of the conductive web 10 and connected to the positive terminal of the D.C. potential source 74. The corotron shield 75 is grounded. In one example, the D.C. potential source 74 may be about +9 KV D.C. Typically, the recharge current is about 30 micro-amps per inch. These parameters produce an optimum recharge potential 76 on the deposited photoelectrophoretic image 6 of about ±160 volts D.C.

Figure 8:
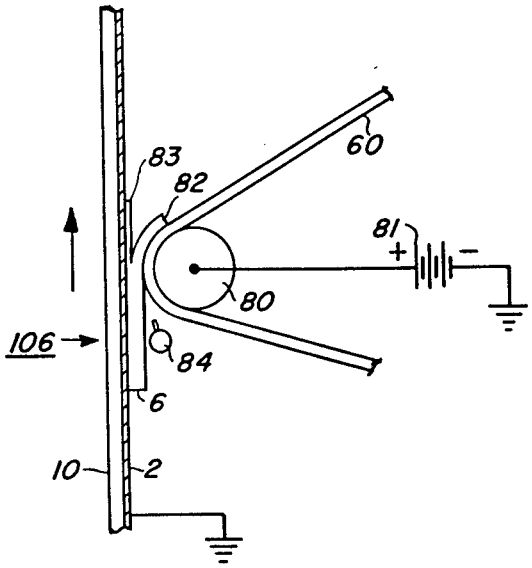
FIG. 8 shows a side view, partially schematic diagram of a detail of the transfer step and method for eliminating air breakdown.

Referring now to FIG. 8, there is shown a side view, partially schematic diagram for illustrating a detail of the transfer step in accordance with one embodiment of this invention. In this embodiment, the deposited photoelectrophoretic image 6 is carried by the conductive web 10 into the transfer zone 106. The paper web 60 is wrapped around the transfer roller 80 which may be formed of conductive metal. In this example, the paper web 60 may take the form of ordinary paper. The positive terminal of the D.C. voltage source 81 is coupled to the transfer roller 80. Typically, voltage source 81 is about +1.4 KV D.C. As the paper web 60 and conductive web 10 are driven into contact with the image 6 sandwiched between them, the paper web 60 is subjected to an electrical charge because it is in contact with the positive transfer roller 80. An electrostatic field is set up through pigment particles to the conductive web 10, which draws the negatively charged pigment particles to the paper web 60 from the conductive web 10 and attaches to the paper web 60. As the paper web is driven around and away from the transfer roller 80, the paper web is thereby separated or peeled away from the conductive web 10, giving the final transferred image 82 on the paper web 60. Substantially all of the pigment or photoelectrophoretic image is transferred onto the paper web 60, however, a small amount of pigment may be left behind in the form of the residual 83 and is carried away by the conductive web 10. The amount of pigment in the residual 83 will usually depend upon such factors as the charge on the pigment particles entering the transfer zone 106, properties of the paper web 60 and the applied transfer voltage by the D.C. potential source 81.

Figure 9:
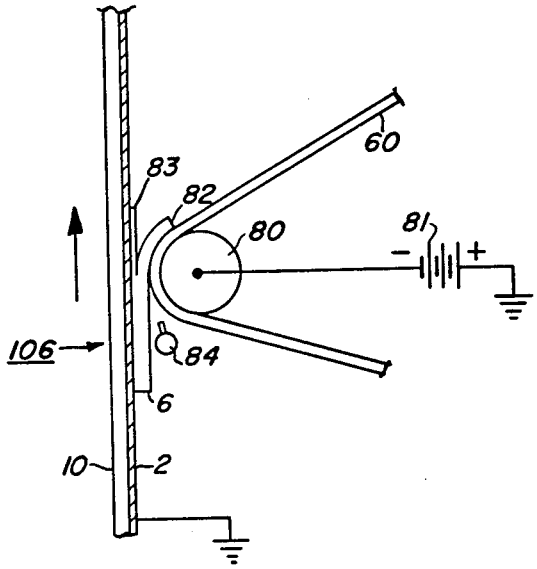
FIG. 9 shows a side view, partially schematic diagram of an alternative embodiment of the transfer step and method for eliminating air breakdown.

It will be noted that while the embodiments of FIGS. 8 and 9 show a residual image, complete image transfer may be achieved without any significant untransferred image or residual.

The residual or untransferred image 83, if any, is carried away from the transfer zone 106, out of the machine and may be disposed of. Because the conductive web 10 is consumable, there is no requirement for a complex cleaning system for performing a cleaning step. This is an important advantage of this machine over earlier photoelectrophoretic imaging machines.

The transfer process step, under certain circumstances, may be subjected to air breakdown in the gap entrance to the transfer zone 106 in the same manner as discussed earlier with respect to the imaging zone. Air breakdown at the entrance to the transfer zone may result in a defect in the final copy, referred to as "dry transfer". Dry transfer, as used herein, is defined as a defect manifesting itself in the final copy in the form of a speckled or discontinuous and very desaturated appearance.

In order to eliminate air breakdown at the transfer zone entrance gap and thus, eliminate dry transfer defects in the copy, a dispenser 84 is provided to apply dichlorodifluoromethane gas ($CCl_2F_2$), Freon-12 from DuPont in the entrance gap. The technique of providing dichlorofluoromethane gas or other suitable liquid or insulating gas medium in the transfer zone entrance increases the level of the onset voltage necessary for corona breakdown. Thus, displacing air in the gap entrance in favor of a dichlorodifluoromethane gas atmosphere improves air breakdown characteristics. Preferably, a vacuum means is provided in the vicinity of the dichlorodifluoromethane gas dispenser 84 to prevent gas from escaping into the atmosphere.

It will also be appreciated that a fluid injecting device 24 (see FIG. 1) may be employed at the inlet nip to the imaging zone 40 to provide air breakdown medium at the imaging nip entrance in the same manner as described with regard to the transfer entrance nip.

Turning now to FIG. 9, there is shown a side view, partially schematic diagram of an alternative embodiment for illustrating the transfer step and method for eliminating air breakdown at the transfer zone entrance gap. The FIG. 9 embodiment differs from the embodiment described with respect to FIG. 8, only in that the transfer roller 80 is coupled to the negative terminal of the D.C. voltage source 81 instead of the positive terminal. It shall be apparent that the FIG. 9 embodiment is utilized whenever the deposited image 6 entering the transfer zone, is charged positive (by a positive D.C. corotron) rather than negative. In this case, the negative 1.4 KV D.C. potential source 81 is coupled to the transfer roller 80. The paper web 60 is charged by being in contact with the negative transfer roller 80. The electrostatic field is set up through the pigment particles to the conductive web 10, which draws the positively charge pigment particles to the paper web 60 from the conductive web 10 and attaches them to the paper web. The paper web 60 is then peeled from the conductive web 10 and contains the final image 82. Practically all of the pigment transfers, and in the manner described with regard to the FIG. 8 embodiment, the untransferred residual 83 is left on the conductive web 10 to be transported out of the machine and later disposed of.

THE MACHINE STRUCTURE

Figure 10:
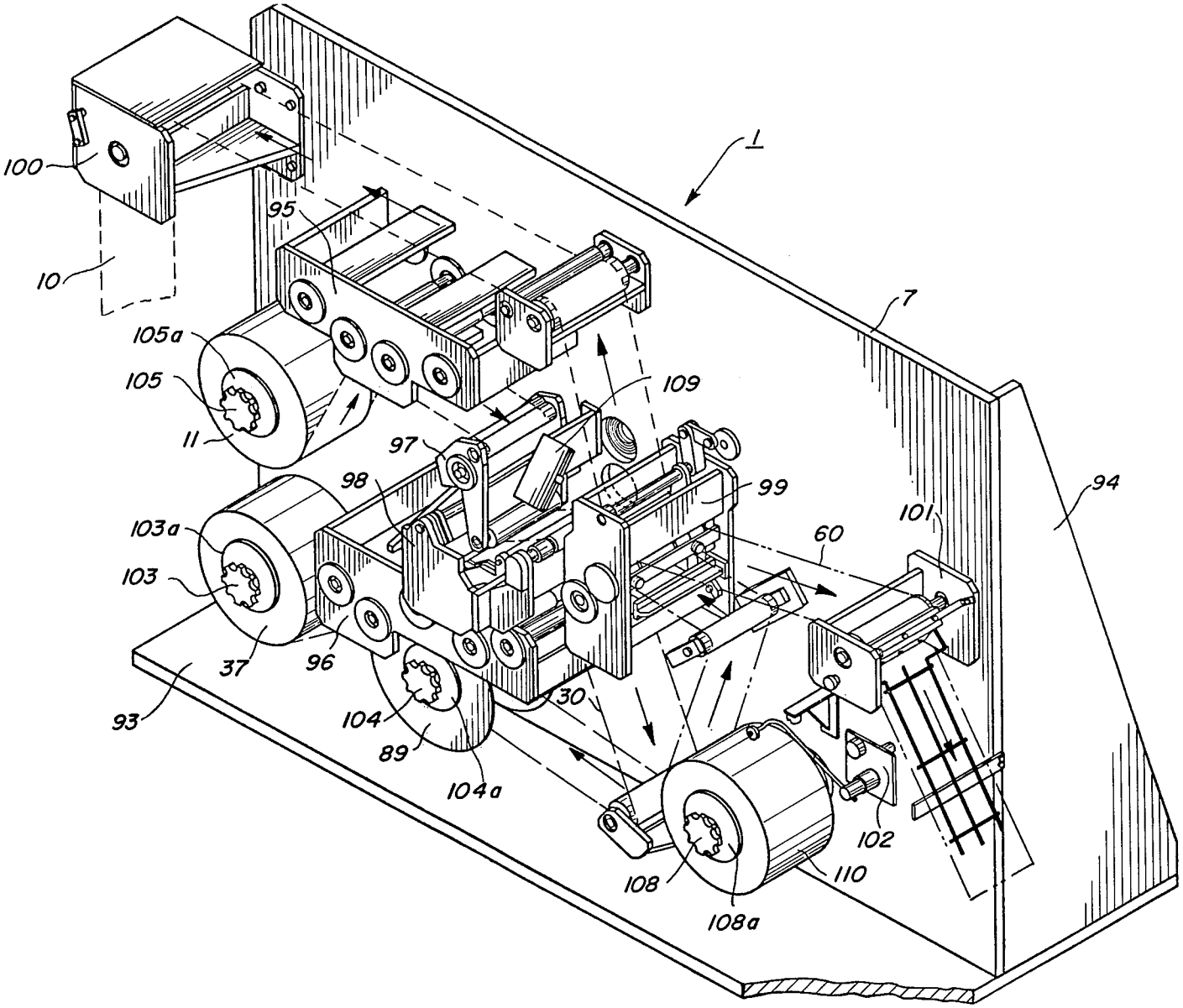
FIG. 10 shows a perspective front view of the overall web device photoelectrophoretic imaging machine.

FIG. 10 shows a perspective front view of the overall web device photoelectrophoretic imaging machine 1, according to this invention. The perspective drawing in FIG. 10 is not drawn to any exact scale, but is merely representative of the components and sub-assemblies comprising the web device photoelectrophoretic imaging machine designated as 1, and is generally representative of relative sizes.

The machine sub-assemblies and components are mounted upon the main frame plate 7. The frame plate 7 is connected to the midpoint of the machine base plate 93. The side support plate 94 is provided at one end of the machine on the rear portion of the base plate 93. The frame 7, base 93 and side support plate 94 may be formed of any suitable mechanically strong material.

The main sub-assemblies mounted on the front side of the frame 7 include the tensioner assemblies 95 and 96, the inker assembly 97, the imaging assembly 98 and the transfer assembly 99. The tensioner assembly 95 is used to rotatably mount tension rollers that control the conductive web 10 tension. Tensioner assembly 95 rotatably mount tension rollers that control the blocking web 30 tension.

Other sub-assemblies mounted on the front side of the frame 7 include the conductive web capstan assembly 100, the paper capstan and chute assembly 101 and the roll radius sensor assembly 102. It will be understood that the conductive web capstan assembly 100 may alternatively take the form of a rewind or takeup roll.

The blocking web supply roll 37 is releasably mounted on the frame 7. The release knob 103 and plug 103a are used to secure supply roll 37 roller shaft to the frame 7 and when desired, to replace the dispensed supply roll by unscrewing the release knob 103. The release knob 104 and plug **104*a* are used to secure the blocking web takeup roll to the frame 7 and to remove the takeup roll by unscrewing the knob 104 when the blocking web supply is completely rewound. The conductive web supply roll 11 is releasably mounted to the front side of the frame 7 by the release knob 105 and plug 105a. Whenever the conductive web has been completely dispensed from the supply roll 11, the knob 105 may be unscrewed and the supply roll shaft released and a fresh supply roll installed for use. Likewise, the paper web supply roll 110 is releasably rotatably mounted to the front side of the frame 7 by the knob 108 and plug 108a in the same manner as rolls 11 and 37, respectively. The front mirror assembly 109** is utilized in conjunction with the opaque optical assembly, to be described in more detail later.

Figure 11:
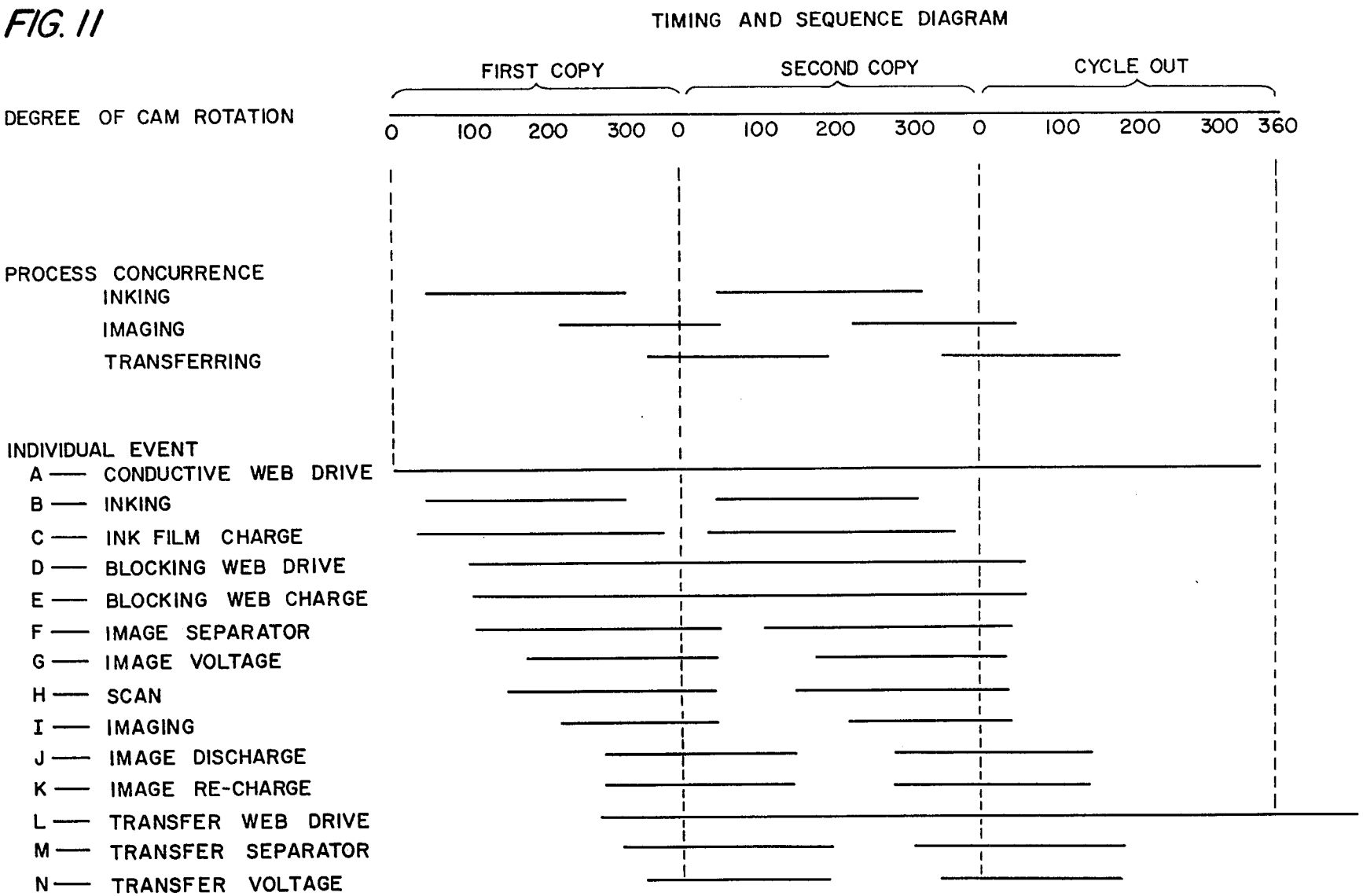
FIG. 11 shows a timing and sequence diagram of the photoelectrophoretic process according to this invention.

Turning now to FIG. 11, there is shown a timing and sequence diagram for the photoelectrophoretic processes and events according to one embodiment of this invention. In this exemplary embodiment, the timing functions on the photoelectrophoretic web device imaging machine may be achieved by a suitable multiple cam switch system driven by the conductive web drive system so that the various processes and events are precisely time actuated in synchronization with the conductive web. The components and subassemblies comprising the machine are arranged and operations controlled such that the photoelectrophoretic processes of inking, imaging and transfer are carried out concurrently throughout 360° of cam rotation. For example, when the imaging process step for an ink film is being completed, the next successive ink film is applied to the conductive web. Also, when the transfer step is being completed, the next successive ink film is being imaged and concurrently another film is being applied to the conductive web. It will be apparent that concurrent operation of the photoelectrophoretic imaging process steps results in the saving of web materials to reduce cost and improve machine thruput. The process concurrence and the relationships of the various events are clearly illustrated by the diagram. It will be noted that in the FIG. 11 embodiment, the transfer web drive will continue to operate beyond the 360° cycle time. The transfer web drive will continue to run beyond the 360° mark on a time delay mechanism (not shown) until a copy is completely out of the machine.

It will also be appreciated that the timing and sequence for the various processes and events may be accomplished by other suitable electronic control means. In this case, the sequence of events and functions are timed in cycles or hertz by a digital frequency source, rather than degrees of cam rotation.

Figure 26:
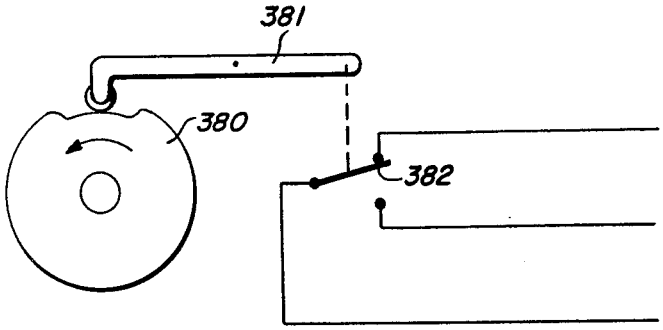
FIG. 26 is a simplified diagram of a cam operated switch.
Figure 27:
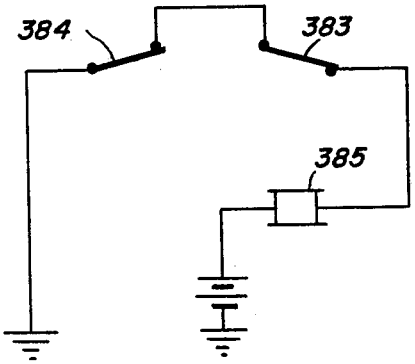

Referring now to the FIGS. 26, 27 and 28 there is shown partial schematic and electrical diagrams of typical electrical circuitry for operation of the cam operated switch according to a preferred embodiment of this invention.

The FIG. 26 shows a simplified diagram of the cam operated switch. The cam 380 rotates in the direction of the arrow and actuates the switch 382 via the cam follower 381. The FIG. 27 illustrates the circuit for events that begin and end in the same 360° cycle. The cam operated switch 383 is closed during the sequence event and the switch 384 may be opened after the last cycle. The particular event is controlled by the series relay 385.

The FIG. 28 is the electrical circuit for events that begin and end in different 360° cycles. The cam operated switch 386 is momentarily closed to start a particular event. The cam operated switch 387 is momentarily opened to end the event and after the last cycle, the switch 388 opens. The particular event is controlled by the series relay 389.

IMAGING ASSEMBLY

Referring again to FIG. 10, as will be recalled, when the conductive and blocking webs are brought together and the layer of ink film reaches the imaging zone to form the ink-web sandwich, the imaging roller is utilized to apply a uniform electrical imaging field across the ink-web sandwich. The combination of the pressure exerted by the tension of the injecting web and the electrical field across the ink-web sandwich at the imaging roller tends to restrict passage of the liquid suspension, forming a liquid bead at the inlet to the imaging nip. This bead will remain in the inlet to the nip after the coated portion of the web has passed, and will then gradually dissipate through the nip. If a portion of the bead remains in the nip until the subsequent ink film arrives, it will mix with this film and degrade the subsequent images.

One method for avoiding the degrading of images from this effect would be to allow lengths of web materials, not coated with suspension, to pass through the imaging zone, after liquid bead build up, sufficient to allow all traces of liquid to pass before an imaging sequence is repeated. This method would entail a time delay between images and would also result in a great deal of waste of web material. An improved method for avoiding this degrading of images is described in copending application Ser. No. 476,189, filed June 4, 1974, entitled "Bead Bypass" by Herman A. Hermanson. The Hermanson bead bypass system is employed to separate two surfaces momentarily immediately after completion of imaging to permit the passage of the liquid bead between image frames.

Another bead bypass system for use in photoelectrophoretic imaging systems, wherein process steps are carried out concurrently or in a timed sequence, is described in copending application Ser. No. 476,188, filed June 4, 1974, entitled "Motion Compensation For Bead Bypass" by Roger G. Teumer, Earl V. Jackson and LeRoy Baldwin. The Teumer et al disclosure is hereby specifically incorporated by reference herein. The Teumer et al motion compensating bead bypass system is employed in the imaging assembly 98 of the instant invention to separate the conductive and blocking webs, having liquid suspension sandwiched between them, to allow the liquid bead formed at the line of contact between the webs to pass therebetween beyond the imaging areas between frames without charging web velocity. After the webs have been moved into contact with each other at the nip, imaging suspension sandwiched therebetween, the separation of the webs may be obtained at the desired time by the use of the cam switch timing systems.

THE OPTICAL ILLUMINATION SYSTEM

Figure 12:
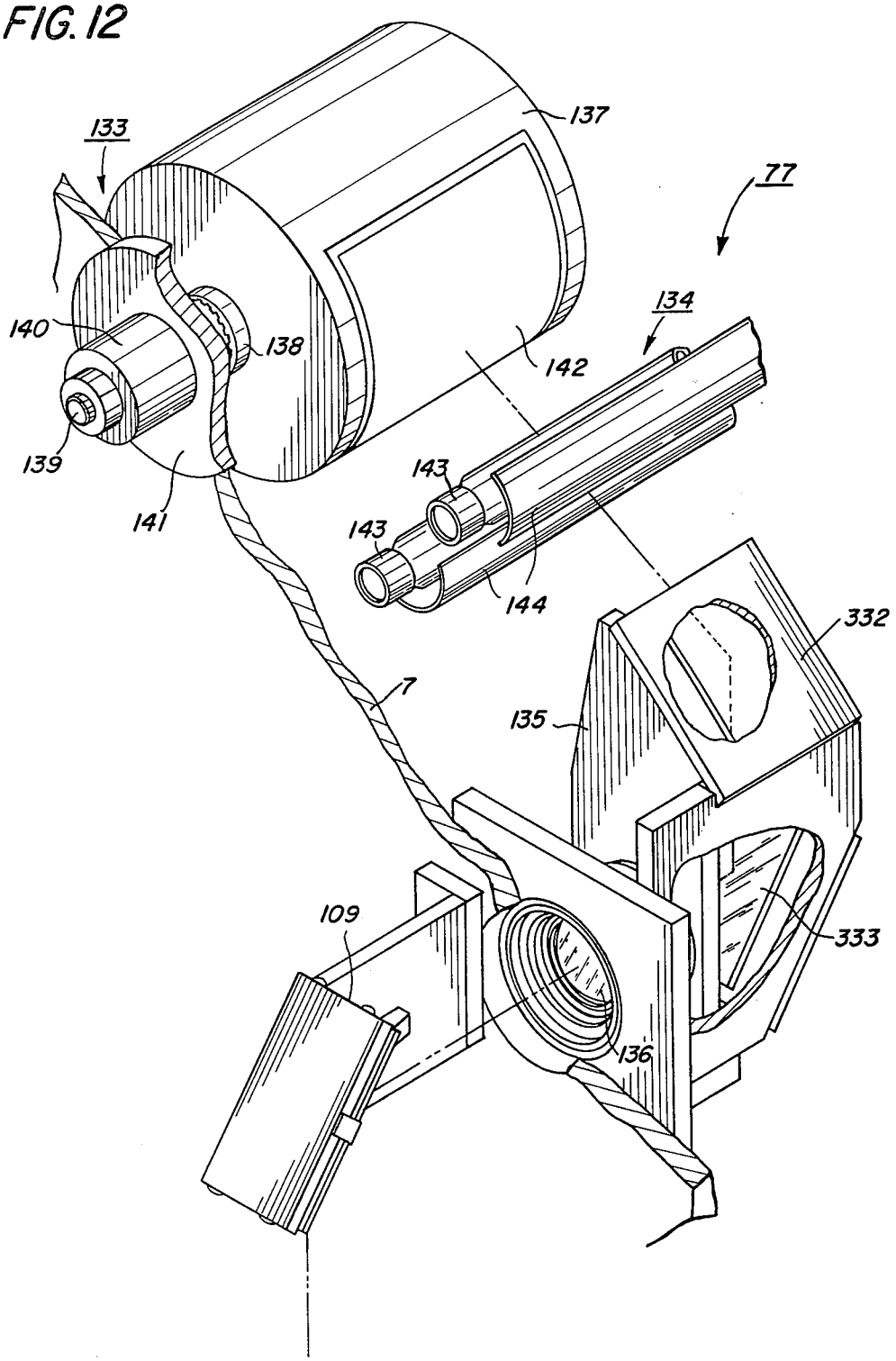
FIG. 12 is a partially cutaway pictorial view of the opaque optical assembly.

In FIG. 12, there is seen a partial cutaway, pictorial illustration of the opaque optical assembly 77, according to this invention. The opaque optical assembly comprises the drum assembly 133, the lamp source 134, the rear mirror assembly 135, the lens assembly 136 and the front mirror assembly 109. The drum assembly 133 consists of the roller drum 137 rotatably mounted to the rear of the main plate frame 7. The roller drum 137 may be formed of conductive metal and is driven by a drive means (not shown) coupled to the drive pulley 138 and drive shaft 139 contained within the bearing housing 140. The drum is attached to the frame 7 by means of the housing base 141 and is adapted to accommodate a positive opaque original document 142 on the drum surface. The original document 142 is exposed by the illumination lamp source 134 comprising the lamps 143 and reflectors 144. The lamps 143 may be metal halide arc lamps by General Electric Corporation. Alternatively,, the lamps 143 may be of the tunsten filament type. The exposed image is reflected to the rear mirror assembly 135 comprising mirrors 332 and 333 through the lens assembly 136 to the front mirror assembly 109 and then to the imaging zone.

A transparency projector and lens assembly may be employed at a convenient location within the machine to project light rays of a color slide to the imaging zone via a mirror assembly. The method and technique for the use of transparency optical inputs in the web device photoelectrophoretic imaging machine will be described in more particularity hereinlater.

THE ALTERNATE MACHINE STRUCTURE

Figure 13:
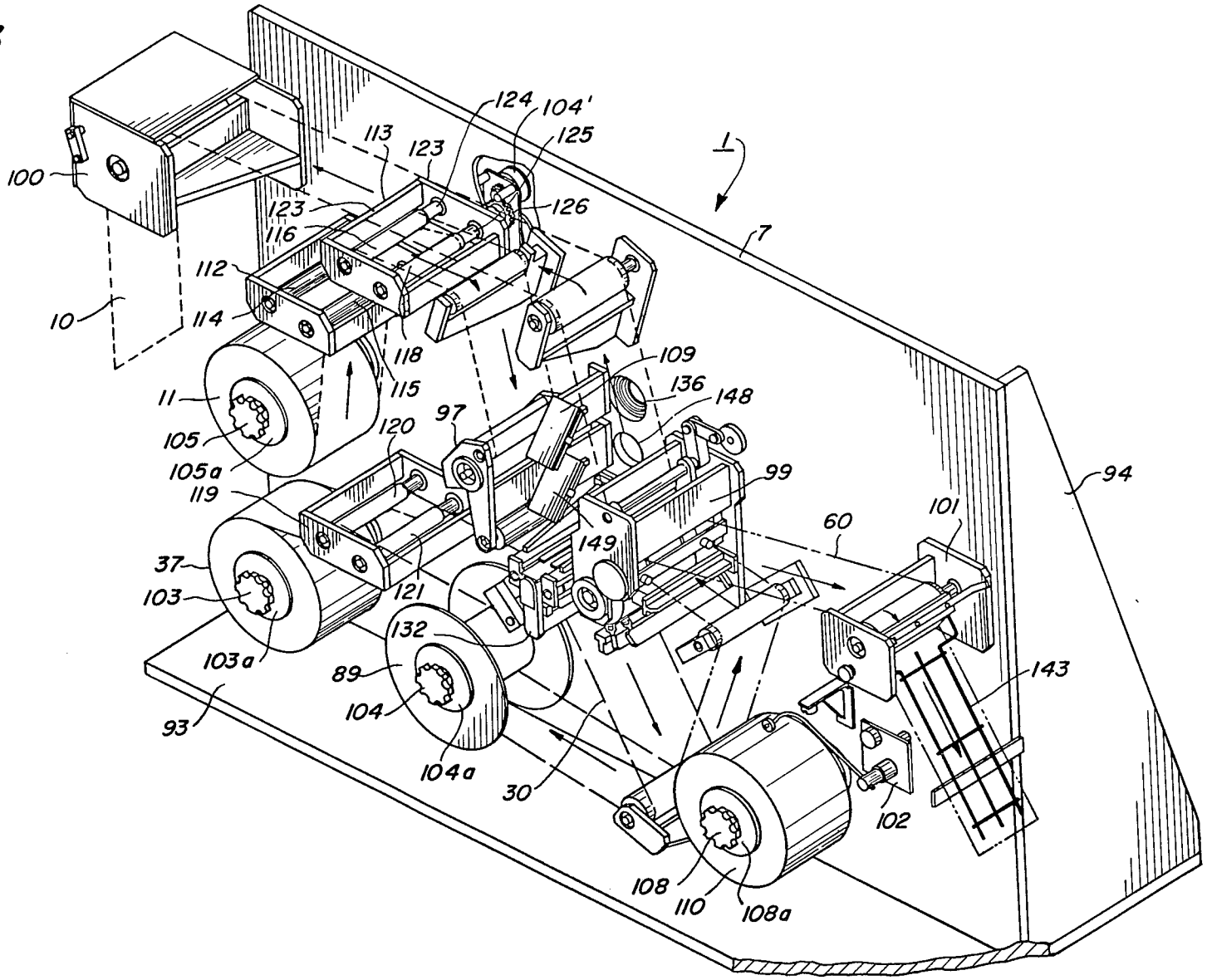
FIG. 13 shows a partially cutaway, perspective view of an alternative embodiment for the machine structure.

Referring now to FIG. 13, there is shown a partially cutaway, perspective, front view of an alternative embodiment for the machine structure. The embodiment shown in FIG. 13 uses the same numerals to identify identical elements described hereinearlier with regard to FIGS. 1–12. The machine structure of FIG. 13 differs from the structure of the FIG. 10 embodiment primarily in the arrangement and location relationship of the various elements and components. The conductive web tensioner rollers may comprise the two cluster assemblies 112 and 113. The cluster assembly 112 may comprise the tension rollers 114 and 115. The cluster assembly 113 comprises the tension rollers 116 and 118. The blocking web tensioner means may comprise the single cluster assembly 119 comprising tension rollers 120 and 121. The three cluster assemblies 112, 113 and 119 are of identical construction, therefore, a description of only one cluster assembly will be necessary. The cluster assembly 113 further comprises the front and rear plates 123 used to mount the tension rollers 116 and 118. The tension roller shafts 124 and 125 are coupled to a hysteresis type adjustable brake means 104' through the pinioned gear train 126 mounted at the rear side of the main plate 7.

The imaging assembly, generally designatd as 132, comprises an upper and lower portion which will be described in more detail hereinafter.

Still referring to FIG. 13, it will be recalled that the mirror assembly 109 and lens assembly 136 are utilized in conjunction with the opaque optical assembly to project light rays from opaque color original documents to the imaging zone. The machine is capable of rapid conversion from opaque optical inputs to inputs of transparency color originals. The machine is designed to allow for projected inputs from alternative positions. A transparency projector and lens assembly may be employed in the opening 148 to project light rays from a projector to the mirror assembly 149 to the imaging zone. Whenever the machine is set up to accommodate opaque inputs, however, the mirror assembly 149 is removed from the machine out of the optical path.

THE IMAGING ASSEMBLY FOR ALTERNATE STRUCTURE

Figure 14:
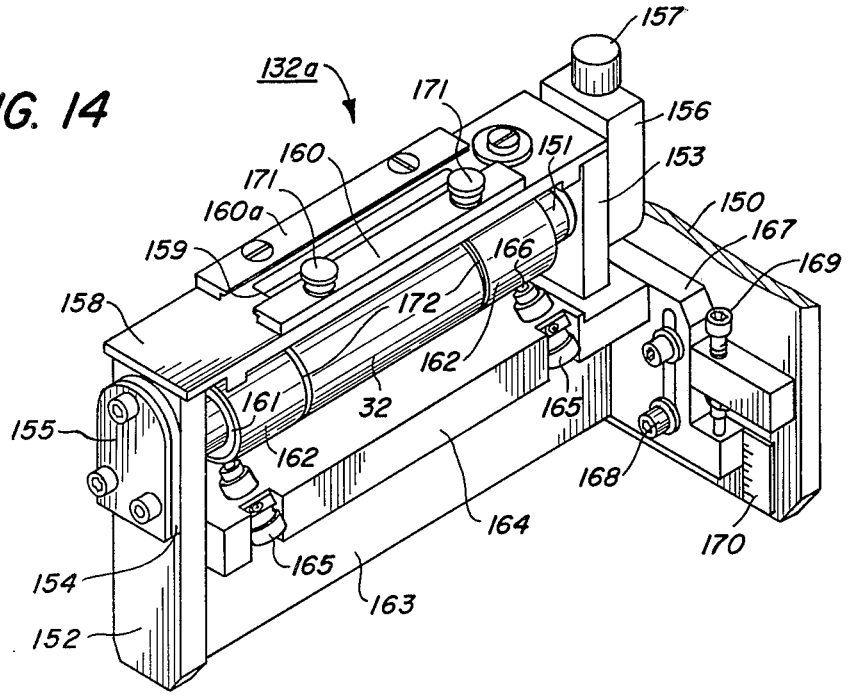
FIG. 14 is a perspective isolated view of the lower portion of the imaging assembly for the alternative machine structure.

Referring now to the FIG. 14, there is shown a perspective isolated view of the lower portion of the imaging assembly 132, generally designated as **132*a*, for the alternate machine structure. The main support plate 150 is connected to the main frame plate by standard screw and socket means. The imaging roller shaft 151 is mounted between front and rear supports 152 and 153 respectively, which may be formed of aluminum material. The front support 152 is provided with the bearing block 154 and end cap 155 both of which are formed of an insulating material such as Delrin, acetal resin (polyacetal) a polyoxymethylene thermoplastic polymer. The rear support 153 is provided with the insulating bearing block 156 at the end of the imaging roller shaft adjacent the main support plate 150. The top end of block 156 contains the plug 157 to couple a voltage source to the imaging roller 32** roller shaft.

The slit support 158, which may be constructed of aluminum with a black anodized finish, is secured to the top of the supports 152 and 153 above the imaging roller 32. The slit support 158 has the center slit 159 of sufficient width and length to expose the formed ink-web sandwich to activatng radiation. The front and rear slit holders 160 and **160*a* respectively, formed of any suitable black anodized finish material, are positioned on the slit support 158 to define the imaging zone. The set screws 171 may be used to adjust the width between slit holders 160 and 160a**.

The imaging roller 32 is provided with concentric insulator rings 161 that are covered with the brass or other suitable conductor sleeves 162 on both ends thereof to facilitate grounding of the conductive web at the imaging roller 32. The top brush support 164, formed on the bar 163, contains the brush assemblies 165. The brush assembly tips 166 contact the brass sleeves 162 to enable an electrical ground or bias to be coupled to the sleeves 162 during an imaging sequence.

The fixture 167 that supports the imaging roller 32 and cooperating mechanism is releasably mounted to the main support 150 by means of screws 168. The screws 168 may be released and the imaging roller 32 relative position adjusted to the desired imaging gap. The set screw 169 may be used for fine hairline adjustment of the imaging gap. The gap setting is indicated by the indicator means 170.

The imaging roller 32, which may be constructed of metal, preferably non-magnetic, is provided with grooves or indentations 172 machined on the imaging roller 32 near the ends to prevent ink and oil from squeezing out from between the webs and spilling over the edge of the webs. A detailed description of this method of overflow prevention is given in copending application Ser. No. 465,644, by Herman A. Hermanson, filed Apr. 30, 1974. That disclosure is hereby specifically incorporated herein by reference.

Figure 15:
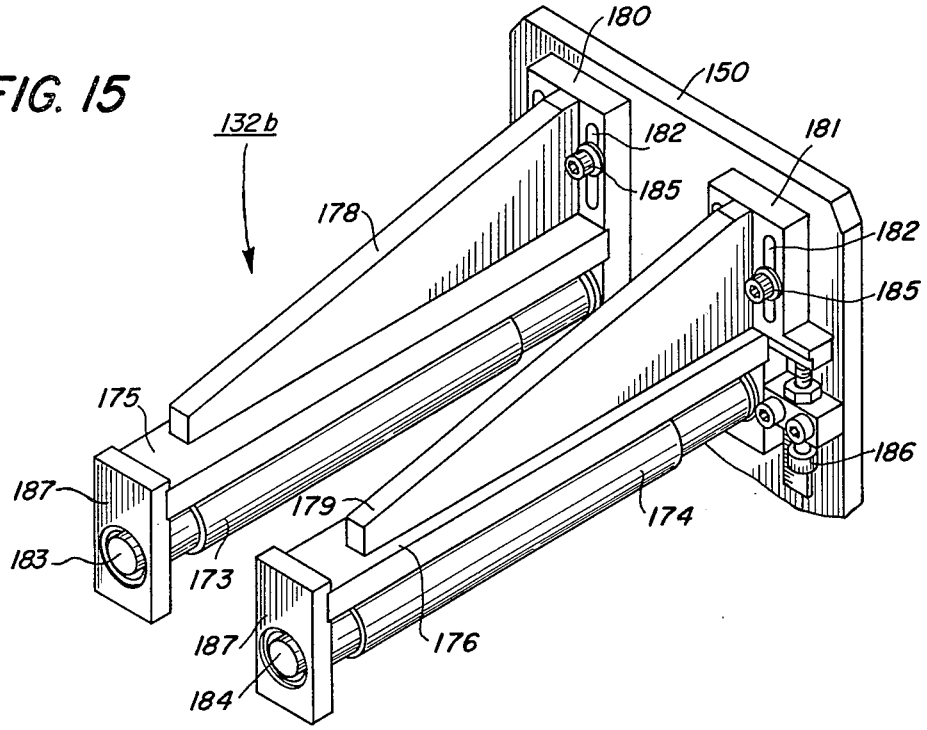
FIG. 15 is a perspective isolated view of the upper portion of the imaging assembly for the alternate machine structure.

The FIG. 15 shows a perspective isolated view of the imaging assembly upper portion designated as 132b. The rollers 173 and 174 are rotatably mounted by the fixtures 175 and 176, respectively, to the main support 150. The roller 173 is positioned above the imaging zone entrance and roller 174 is located above the imaging zone exit. The fixtures 175 and 176 are provided with tappered flange members 178 and 179, respectively. The flange members are connected to the base plates 180 and 181 which contain vertical slots 182. The imaging zone entrance roller 173 and exit roller 174 roller shafts 183 and 184, respectively, are supported by the base plates 180 and 181 and end members 187.

The adjustable attaching members 185 in conjunction with the slots 182 may be used to adjust the rollers 173 and 174 in a vertical plane to thereby adjust the imaging gap and wrap angle. The fine adjust means 186 are provided for each of the rollers 173 and 174 and may be used to obtain precise gap settings.

THE TRANSFER ASSEMBLY

Figure 16:
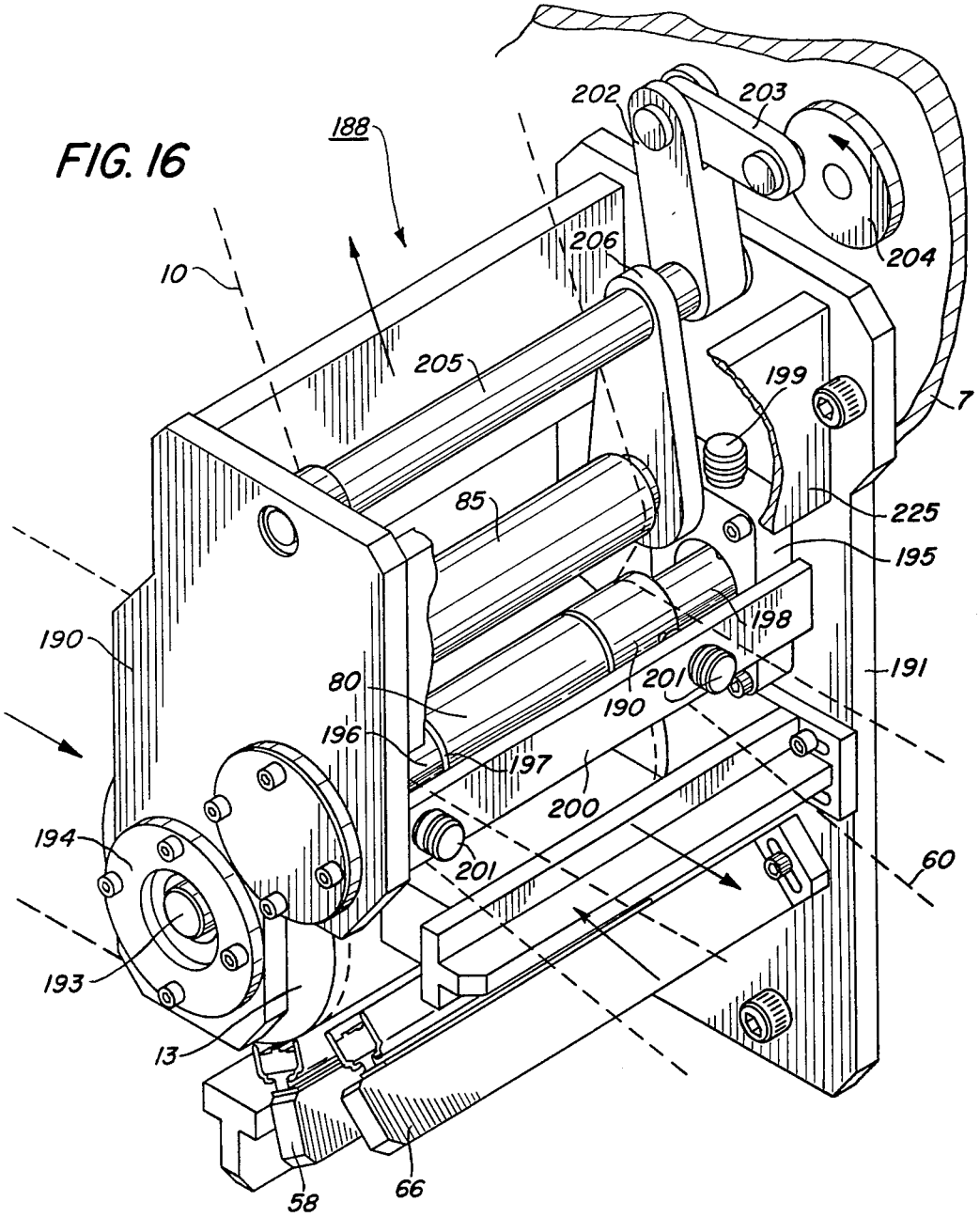
FIG. 16 is a perspective isolated view of the transfer assembly.

Referring now to FIG. 16, there is shown a perspective isolated view of the transfer assembly designated as 188. The transfer assembly 188 includes the front and rear plates 190 and 191, respectively. The rear plate 191 is utilized to attach the transfer assembly 188 to the main frame 7. The capstan drive roller 13 is used to transport the conductive web 10 into contact with the paper web 60 at the transfer zone. The capstan drive roller shaft 193 is rotatably mounted between the front and rear plates 190 and 191 by the bearing block 194 provided at one end of the shaft 193. The other end of the capstan drive roller shaft 193 extends beyond the rear plate 191 and the frame plate 7 and may be connected to capstan roller drive means through drive pulley and timing belt means, not shown.

The discharge corotron 58 that may be used to discharge the photoelectrophoretic image carried by the conductive web from the imaging zone, is mounted to the rear plate 191 adjacent and in an axis parallel to the drive roller 13. The pigment recharge corotron 66 is mounted in a similar fashion to the rear plate 191 in the direction of travel of the conductive web 10 after the discharge corotron 58.

The transfer roller 80, used to effect the electrostatic transfer step, is rotatably mounted by the bearing blocks 195 that are attached to the front and rear plates 190 and 191. The transfer roller 80 construction may be similar to the imaging roller construction. For example, the transfer roller 80 is provided with concentric insulator rings (not shown) and the conductive end sleeves 196. Grooves or indentations 197 are provided on the transfer roller 80 near the ends to prevent pigment and oil liquid from spilling out from the edge of the webs. The bearing blocks 195 that are used to mount the transfer roller 80 are formed of an insulator material and is provided with the electrical connector means 199 to couple an electrical voltage source to the transfer roller shaft 198. The bar 200, which extends parallel with and in close proximity to the transfer roller 80, is provided with the brush assemblies 201 used to couple the end sleeves 195 to an electrical bias or ground.

The image deposited on the conductive web 10 approaching the transfer zone, includes oil and pigment which may be outside the actual copy format area and may also include a relatively large bead of oil at the trailing edge. This excess oil, if allowed to remain in the copy format area, may adversely affect the transferred image. This excess oil may be removed from the transfer zone by separating the paper web 60 from contact with the conductive web 10, briefly after the transfer step to allow excess oil and pigment to clear the transfer zone. Web separation at the transfer zone is accomplished by moving the conductive-transfer web separator roller 85 by driving the link 202 and arm 203 by the drive means 204. The link 202 and arm 203 are coupled to the separator roller 85 through the rod pivot 205 and support arms 206. Initially, the conductive and paper webs are separated apart. In this case, the roller 85 is in the standby or non-transfer mode. Upon receiving an actuation signal, the drive means moves in the direction of the arrow causing the separator roller 85 to move toward the transfer roller 80, thus bringing the webs together. When a second signal is received by the drive means 204, the drive means rotates and the separator roller 85 returns to the standby position. This sequence may be repeated for the next successive transfer step.

Figure 16A:
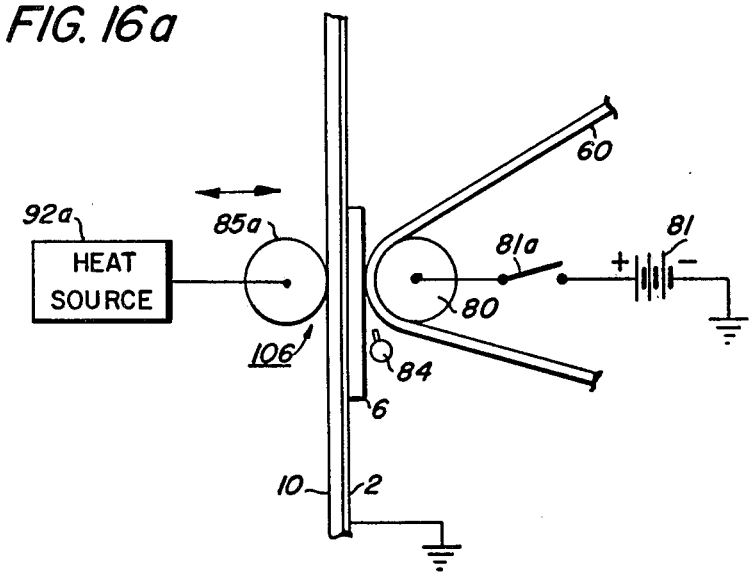
FIG. 16*a* shows a side view, partially schematic diagram of one preferred embodiment for transferring and fixing in one step.

Referring now to FIG. 16*a*, in one preferred embodiment, the paper transfer web 60 may take the form of polyamide coated paper. When polyamide coated paper is used as the paper web 60, photoelectrophoretic imaging machines employing the disposable web configuration may be further simplified. In such case, the transfer and fixing steps may be accomplished in one step by bringing the conductive web into contact with the polyamide coated paper web 60 at the transfer zone 106 between two rollers and applying heat and pressure. The pressure roller 85*a* moves under force in the direction of the arrow to bring the webs into contact at the transfer zone 106, the image 6 sandwiched between the two webs. The pressure roller 85*a* is coupled to the heat source 92*a*. This results in a substantially complete transfer of all pigment particles from the conductive web 10 to the polyamide coated paper web 60 and the image is fixed simultaneously.

In still another alternative embodiment, an electric field may be applied during the application of heat and pressure. In this case, the switch 81a is used to couple the voltage source 81 to the transfer roller 80.

THE WEB DRIVE SYSTEM

Figure 17:
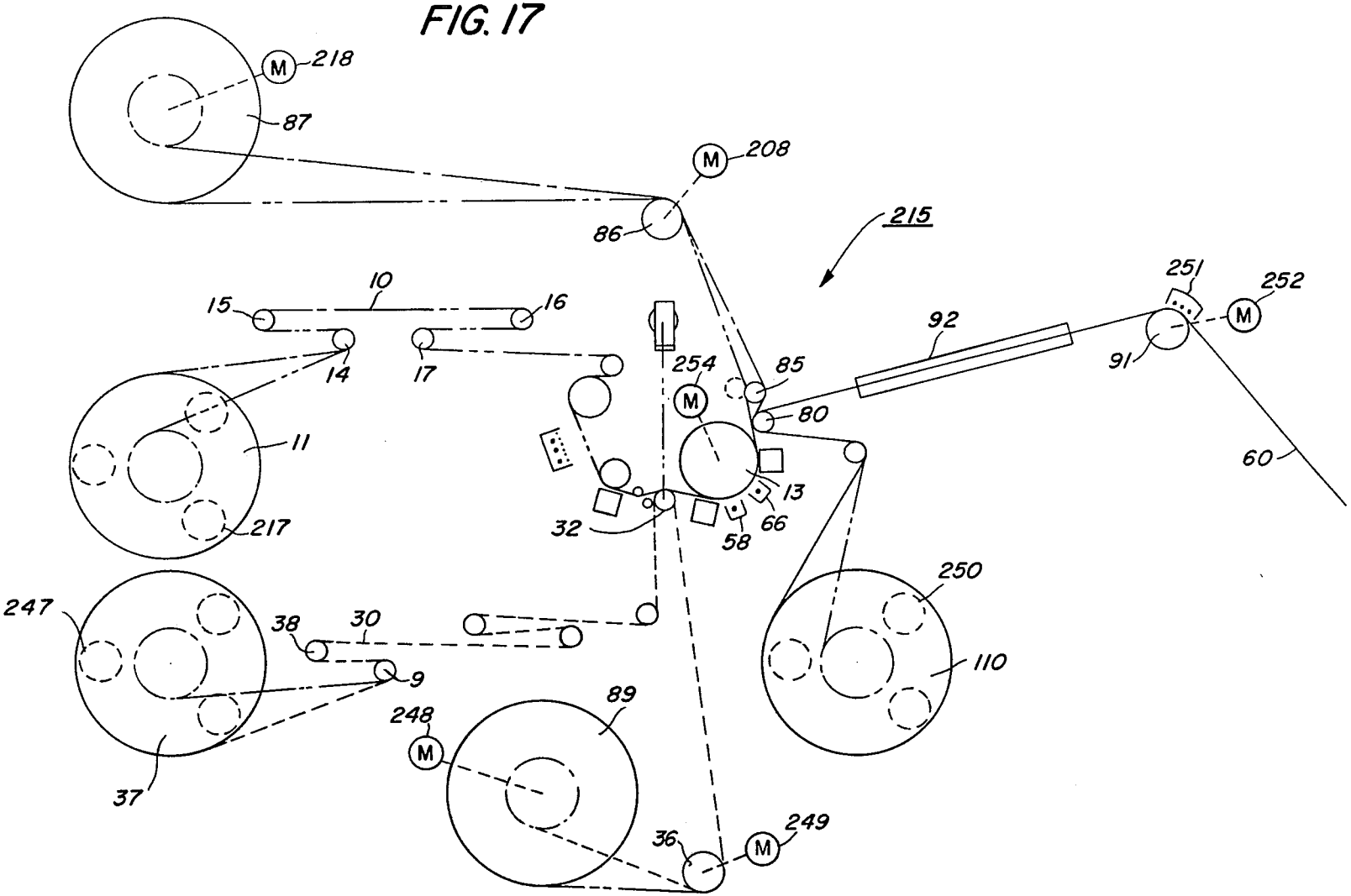
FIG. 17 shows a side view, partially schematic diagram of the web drive system and web travel paths.

In FIG. 17, there is shown a partially schematic diagram of the web device drive system (and web travel paths) generally represented as 215 according to this invention. The photoelectrophoretic imaging machine web drive, according to this invention, is designed to have relatively constant tension maintained on each web with constant velocity control applied through a friction capstan drive. No relative motion can be tolerated between the conductive and blocking webs at the image roller and the conductive web and paper web at the transfer roller. Therefore, the conductive web is employed as the controlling web and velocity of the other webs is matched to it and driven by it during the photoelectrophoretic process steps of imaging and transfer.

The conductive web 10 supply roll 11 is braked by the cluster of 3 small permanent magnet hysteresis brakes 217, shown in dotted outline. The brakes 217 are manually adjustable in finite steps. The hysteresis brakes 217 are normally adjusted to a fixed torque level such that the tension in the web varies between one-sixth and ⅓ lb./inch of web width as the conductive web supply roll 11 decreases in roll diameter. Since the desired operating tension level is 2.5 lb. per inch of web width, the tension is increased to this level by passing the conductive web 10 around the series of 4 braked friction capstan rollers 14-17. A cluster of hysteresis brakes (not shown) similar to the brakes 217 on the supply roll is attached to each capstan roller. The amount of braking force each of the rollers 14–17 can supply is limited by the friction force available at each roller-web interface and this necessitates the use of multiple rollers.

The takeup tension on the conductive web 10 is supplied by the takeout capstan roller 86 and conductive web takeup roller 87. Takeout capstan roller 86 transmits tension to the conductive web by means of the friction roll capstan driven at constant torque by the torque motor 208 that is maintained at a suitable current level to supply constant torque when the conductive web is either standing still or moving. The conductive web takeup roller 87 is driven by a similar motor 218, however, its current level and hence, torque output is controlled by a radius sensor. The takeup tension is the sum of the torque supplied by the takeout capstan and the takeup roll and is set at a level slightly below the total tension level set at the braked rolls so that the web will not move during machine standby.

Figure 17A:
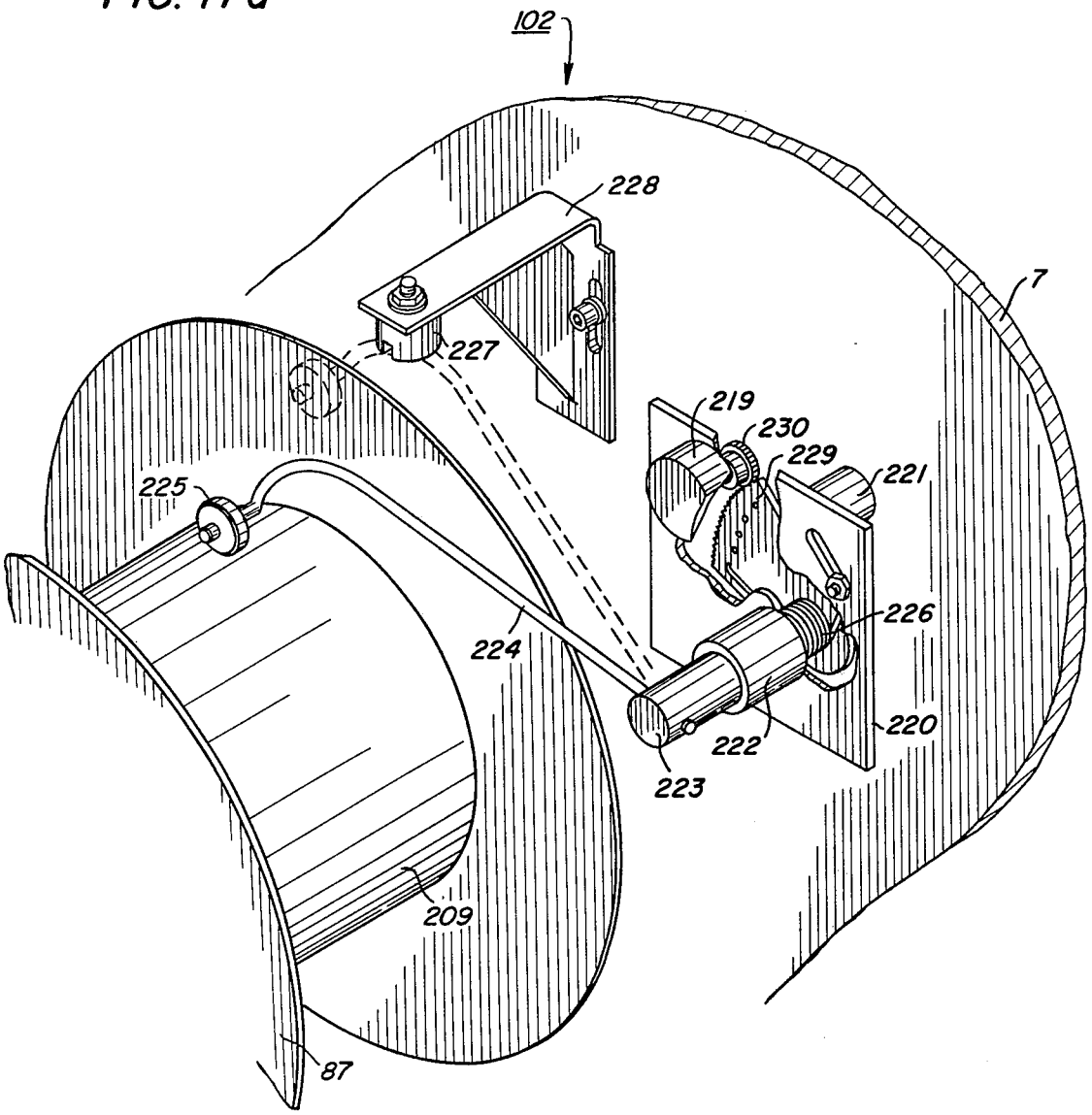
FIG. 17*a* is a perspective isolated view of the roller radius sensor.

FIG. 17*a* shows a perspective isolated view of the radius sensor generally represented as 102. The radius sensor rides on the roll diameter 209 and controls the potentiometer 219 which changes the current to the motor 218 (see FIG. 17) as the roll radius changes. The radius sensor mounting plate 220, mounted to frame 7 by the mounting post 221, carries the bearing housing 222 and hub 223. The radius arm 224 which may be formed of mild steel, is connected to the potentiometer 219 via the hub 223. The roller 225, constructed of an insulating material such as Delrin, acetal resin (polyacetal), is rotatably mounted on the arm 224 and is urged into pressure engagement with the web diameter by the coil 226. The magnetic button 227, carried on the bracket 228 is situated to attract the conductive arm 224 as indicated by dotted outline. The displacement of the arm 224 is transmitted via the segment gear 229 and spur 230 to the potentiometer 219.

Figure 17B:
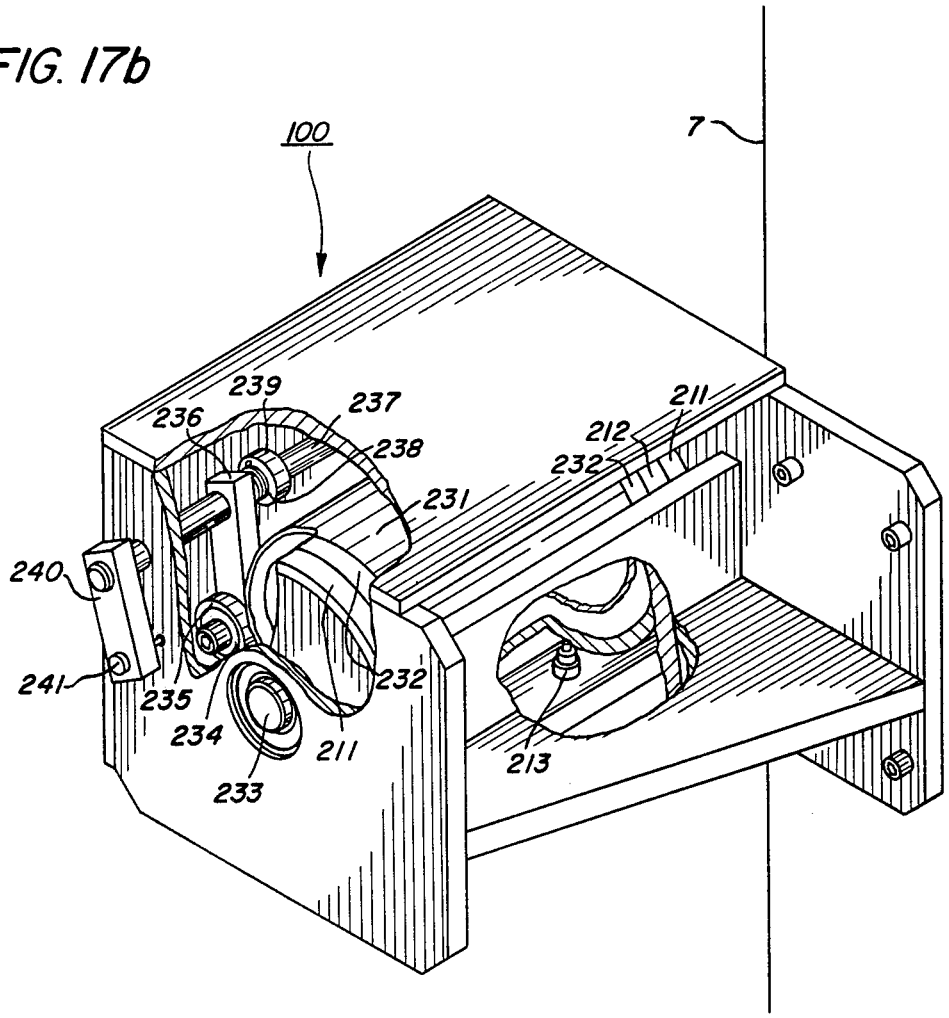
FIG. 17*b* is an isolated perspective view of the conductive takeout capstan assembly.

Turning now to FIG. 17*b*, there is shown an isolated, partially cutaway, perspective view of an alternative tensioning device 100 for the conductive web which permits the conductive web to be saved rather than rewound. In the FIG. 17*b* embodiment, the takeup roller 87 is replaced by the tensioning device 100. The tensioning device electrostatic capstan drive roller 231 is driven by a separate torque motor (not shown) set at constant torque. Tension is supplied to the conductive web 10 from the roller 231 via electrostatic tacking force between the roller and web. This is achieved by grounding the conductive side of the web 10 which is not in contact with the roller 231 and applying a pulsed D.C. voltage to the roller.

A high voltage is applied intermittently to the electrostatic capstan roller 231 causing the web 10 to tack to the capstan roller with an appreciable normal electrostatic force. This will allow appreciable tension to be applied to the conductive web 10.

The voltage is pulsed to roller 231 at a suitable frequency to avoid nip entrance breakdown on approximately 50% of the area that the conductive web 10 makes contact with the capstan roller 231, since tacking will not take place in the area which has passed through the entrance to the nip while the high voltage is on.

The roller 231 may be constructed of metal and is provided with the insulator sleeves 232 and end caps 211 on the ends of the roller. The inside end of roller 231 is provided with the conductive metal sleeve 212 that is coupled to ground by the brush assembly 213. The roller shaft 233 is keyed to suitable pulley means which is driven by the constant torque motor. The contact rollers 234, that are covered by the conductive rings 235, which may be neoprene, polychloroprene $(C_4H_7Cl)_n$, are rotatably mounted by the arms 236. The arms 236 and conductive covered rollers 234 are carried by the shaft 237. The rollers 234 are maintained in contact with the capstan roller 231 and conductive web contained thereon by the torsion springs 238 and collars 239. The lever 240 provided with the spring plunger 241 may be used to adjust the contact pressure. The rollers 234 are used to couple web 10 to an electrical bias.

Returning now to FIG. 17, the blocking web 30 braking system is similar to the conductive web system described above. The blocking web 30 supply 37 is braked by a cluster of hysteresis brakes 247 which are set to provide tension between 1/6 and ⅓ lb./inch of web width as the roll diameter varies. Only two braked friction capstan rollers 9 and 38 are required to raise the blocking web 30 tension to the desired level of about 1 lb.inch of web width.

It is desirable to maintain a very closely balanced tension on the blocking web 30, i.e., the takeup tension is maintained very close to the brake tension so that minimal force is required to move the blocking web and yet not creep during machine standby. The takeup tension is provided by the blocking web drive capstan roller 36 and the blocking web takeup roller 89. The blocking web takeup roller 89 is driven in the same manner as the conductive web takeup roller that is, by the torque motor 248 which is controlled by a radius sensor to maintain a constant tension level. The blocking web driven capstan roller 36 is a friction capstan which is driven by the torque motor 249. The torque motor 249 can be controlled in either a torque or speed mode. When in the torque mode, the tension level is controlled by a radius sensor on the blocking web 30 supply roll 37 to maintain a balanced tension level in the blocking web 30 as the supply radius changes.

The paper web 60 is also maintained in a balanced tension condition. The paper web supply roll 110 is also braked by a cluster of hysteresis brakes 250 described on the conductive web supply roll 11. The torque is a constant and the tension on the paper web 60 varies as the supply roll diameter varies. The paper web drive capstan roller 91 provides both tension and speed control to the paper web 60. The paper web drive capstan roller 91 is an electrostatic capstan which transmits tension to the paper web 60 via electrostatic tacking forces between the roller 91 and paper web 60. The corotron 251 provides the necessary charge for electrostatic tacking. The electrostatic capstan 91 is driven by the torque motor 252 in the same manner as the blocking web capstan drive roller 36. The torque motor 252 can be controlled in a speed or torque mode. When in the torque mode, the level is controlled by a radius sensor on the paper web supply roll 110 to maintain a balanced level in the paper web 60.

The main drive capstan roller 13 is used to drive the conductive web 10 through friction contact at the desired web velocity. Friction capstan roller 13 is driven by the D.C. servo torque motor 254 that is provided with tachometer feedback at constant velocity. The torque motor 254 may also be employed to drive the scan for both opaque and transparency optics and the machine time sequence cam switch system referred to hereinearlier. The torque motor 249 used to drive the blocking web capstan drive roller 36 is a D.C. servo motor with tachometer feedback when in the speed mode. The paper capstan drive roller 91 is driven by the torque motor 252 which is also a D.C. servo motor with tachometer feedback when in the speed mode.

In operation, when the machine is turned on, power is supplied to the torque motors 218 and 208 driving the conductive web 10 takeup, motors 248 and 249 driving the blocking web 30 takeup and motor 252 driving the paper web 60 takeup. Tension is applied to the three webs. The webs do not move after they are tensioned. The torque motors 249 and 252 for the blocking and paper webs, respectively, are in the torque mode.

When an image cycle is started, the conductive web capstan drive roller 13 is driven by the motor 254 to accelerate the conductive web to the desired velocity. Shortly thereafter (by cam switch timing) the blocking web drive motor 249 is switched from torque to speed mode and accelerates the blocking web 30 up to a closely matched velocity with the conductive web. All three webs are separated out of contact, at this time. The conductive web 10 is inked and deposition takes place. As the lead edge of the ink film approaches the image roller 32, the conductive web 10 is brought in contact with the blocking web forming the ink-web sandwich and the blocking web drive 249 is switched, via a switch on the conductive blocking web separator mechanism, back to torque mode. During the time that imaging takes place (or the webs are in contact), the blocking web 30 is driven by the conductive web 10 through friction between the webs at the imaging roller nip. The required driving force is kept low because of the balanced tension condition on the blocking web. After the image is formed, the conductive web 10 separates from the blocking web 30 and the blocking web drive motor 249 switches again to speed mode where it remains until the next ink film approaches the image roller 32 or the cam switch timing system signals it back to torque mode at the end of the cycle and the web stops.

From the imaging roller 32, the conductive web 10 continues passing corotrons 58 and 66 and as the lead edge of the newly formed image approaches the transfer roller 80 the paper web drive motor 252 is switched to speed mode (by cam switch timing) and accelerates the paper web 60 to a speed closely matching that of the conductive web 10. The conductive web 10 is then brought into contact with the paper web at the transfer roller 80 and a switch on the conductive-transfer web separator mechanism returns the paper web drive motor 252 to torque mode.

During the time that transfer takes place, the paper web capstan drive motor 252 remains in torque mode and the conductive web 10 drives the paper web 60 through friction contact at the transfer nip. The required driving force is kept low because of the balanced tension condition on the paper web. When transfer is complete, the conductive web 10 is separated from the paper web 60 and the paper web drive motor 252 is switched back to speed mode. As the residual image, if any, on the conductive web 10 clears the transfer roller 80, the conductive web is stopped. The paper web 60 continues in the speed mode until the transferred image is out of the machine and a time delay relay switches the paper web drive motor 252 back to torque mode, stopping the paper web. The machine is now ready for the next cycle.

THE WEB SERVO SYSTEM DRIVE CONTROL

Figure 18:
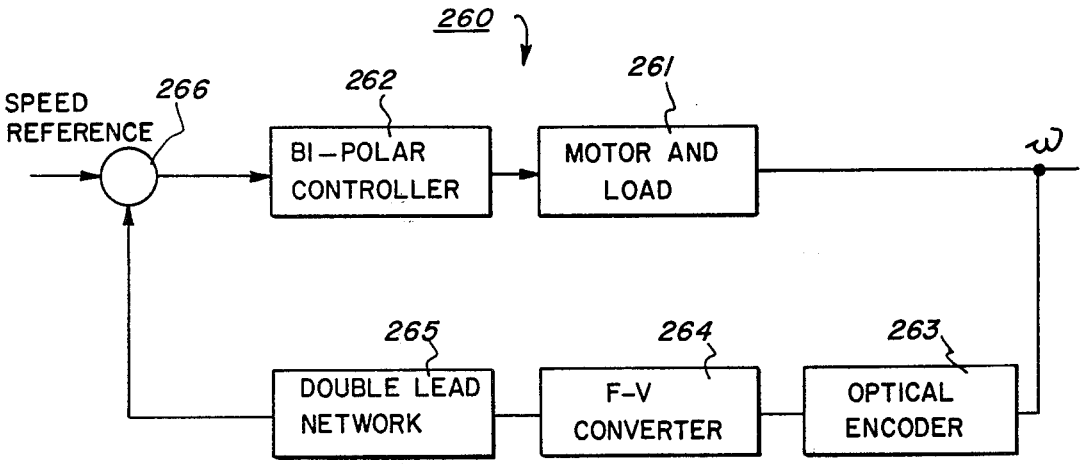
FIG. 18 is a block diagram of the servo control drive system for the conductive web.

Referring now to FIG. 18, there is shown a simplified block diagram of the conductive web servo control drive system 260. The conductive, blocking and transfer webs are driven by essentially independent servo control drive systems. The servo drive systems cooperate in the transporting of the various webs to eliminate or minimize relative speed differential tensions between two webs that are held together by mechanical friction and electrical tacking force. The motor and load, represented as 261, is bi-polar controlled by 262. The speed of the motor $\omega$, is sensed by the optical encoder 263 and the sensed signal is applied to the frequency to voltage converter (F-V) 264 for feedback. The feedback signal from the F-V converter 264 is coupled to the double lead network circuit 265 for stability, and therefrom, to a summing point with speed reference 266 where a comparison is made for determining the error signal to be applied.

The FIG. 19 is a block diagram of the servo drive system 270 for the blocking and paper webs. The speed of the blocking and transfer web servo drives are set so that the linear velocity of the blocking and transfer webs are slightly slower than the linear velocity of the conductive web. The servo drive system 270 essentially is a hybrid control system switched by the switch 271 between speed and torque control modes. When the webs are held apart by the separator mechanism during imaging or transfer, the hybrid control drive system 270 will be in speed control mode, and when the webs are in contact during imaging and transferring, the hybrid control drive system is in the torque control mode.

The motor and load 274 is uni-polar controlled by 275. The current sensor 276 detects the load current, I, that is coupled into the current to voltage converter (I-V) 277. The signal from the I-V converter 277 is fed back to the torque reference 272 for updating during speed drive. The speed for the blocking web and paper web is sampled by the optical encoder 278 and the sensed signal is fed to the frequency to voltage converter (F-V) 279 for feedback purposes. The signal from the F-V converter 279 is applied to the double lead network 280 for stability and into the comparing circuit for comparison with speed reference 273 for determining the error signal.

The FIG. 20 is a chart of the speed-torque curve for the hybrid control drive system 270. Whenever the blocking and paper webs are separated from the conductive web, the blocking and paper webs are both in the speed control mode controlled by two independent servo systems with different speed reference settings $\omega 1$ and $\omega 2$. Assuming that the two servo systems are identical, the conductive web drive motor develops torque (T) T1 with web running at speed $\omega 1$, while the blocking web or paper web drive motor develops torque T2 with web running at speed $\omega 2$. The rates of speed for $\omega 1$ and $\omega 2$ are close in value.

Whenever two webs are in contact, for example, the conductive web and the blocking web, the blocking web servo drive system will be in the torque control mode. If there is sufficient electrostatic pressure and friction between the two webs to compensate for the small deficiency of torque being supplied by the blocking web torque control system, then the two webs will move at the same rate of linear velocity. If in the process of making contact between the conductive and blocking webs, contact is made before the blocking web drive system is switched to the torque control mode, then the blocking web linear velocity will be brought up to that of the conductive web without resistance from the blocking web control system. This is because the blocking web servo is a uni-polar control system. The motor does not see the negative error signal. When the blocking web is driven by external means and running at a speed higher than the set point speed, the torque developed by the blocking web drive motor will decrease to zero. Since the conductive web drive observed an additional load for pulling the blocking web, the torque developed by the conductive drive motor will be increased from T1 to T3, or T1 + T2.

Before the conductive and blocking webs are brought together, the required torque, T2, developed by the blocking web drive motor can be sampled and stored in the torque reference update circuit. Alternatively, a fixed torque reference may be used.

It will be noted that if the tacking force between webs is such that the conductive web can drive the blocking (or transfer) web in the absence of a specific controlled driving force being applied to the blocking or transfer web, then speed to torque switching is not required. It will also be appreciated that if the linear velocity of the separated blocking or transfer web, driven by a uni-polar servo drive, is slightly less than the linear velocity of the conductive web with a bi-polar drive, when the webs are in contact, the bi-polar servo drive can overrun the blocking or transfer web uni-polar servo drive system without any resistance being offered.

After the two webs are brought together and the blocking web drive system is switched to torque control, the blocking web drive motor will develop a torque of T2. Since the torque T2 can only make the blocking web drive motor run at the speed of $\omega 2$, and the blocking web drive motor actually runs at the speed of $\omega 1$, thus the conductive web drive will have to develop a torque of T4, which is T1 + $\Delta$T.

The quantity $\Delta$T is the additional torque developed by the conductive web drive to carry the blocking web, so that the blocking web will run at the speed of $\omega 1$ even through the blocking web drive system can only run at the speed of $\omega 2$. The quantity $\Delta$T also determines the amount of tacking force required to hold the two webs together without slipping.

BIASING THE CONDUCTIVE WEB

Figure 21:
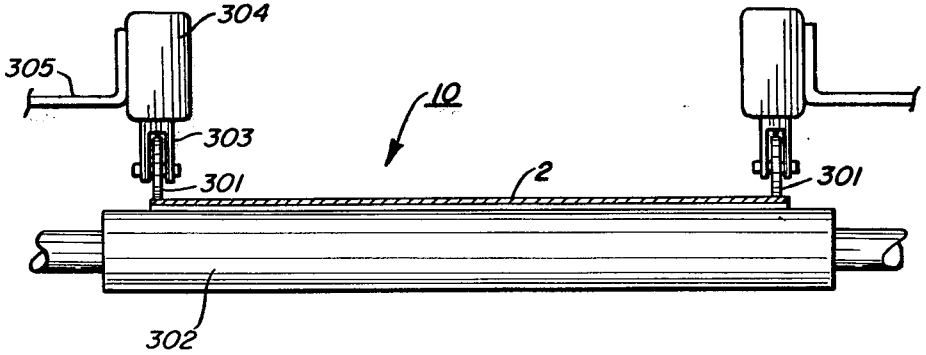
FIG. 21 shows a partial sectional view of one embodiment for grounding the conductive web.

Referring now to FIG. 21, there is seen an elevation sectional view of one embodiment of the method of biasing the conductive web. As will be recalled, the conductive web 10 is grounded (or electrically biased) during both the imaging and transfer process steps. The grounding rollers 301, situated adjacent the backup roll 302, may be provided just prior to the imaging and transfer zones. In this case, the grounding rollers or contact brushes 301 engage the conductive surface 2 outside the inked or image format area. The rollers 301 are mounted to engage the web surface by support rods 303 that are maintained by the ground blocks 304. The ground blocks 304 are attached to the brackets 305 that connect to the machine frame.

The grounding rollers 301 and backup roll 302 may be positioned at a location in advance of the inking station to ground the conductive web 10 during the imaging sequence. Also, the grounding rollers and backup roll may be positioned outside the transfer zone to ground the conductive web during transfer.

Figure 22:
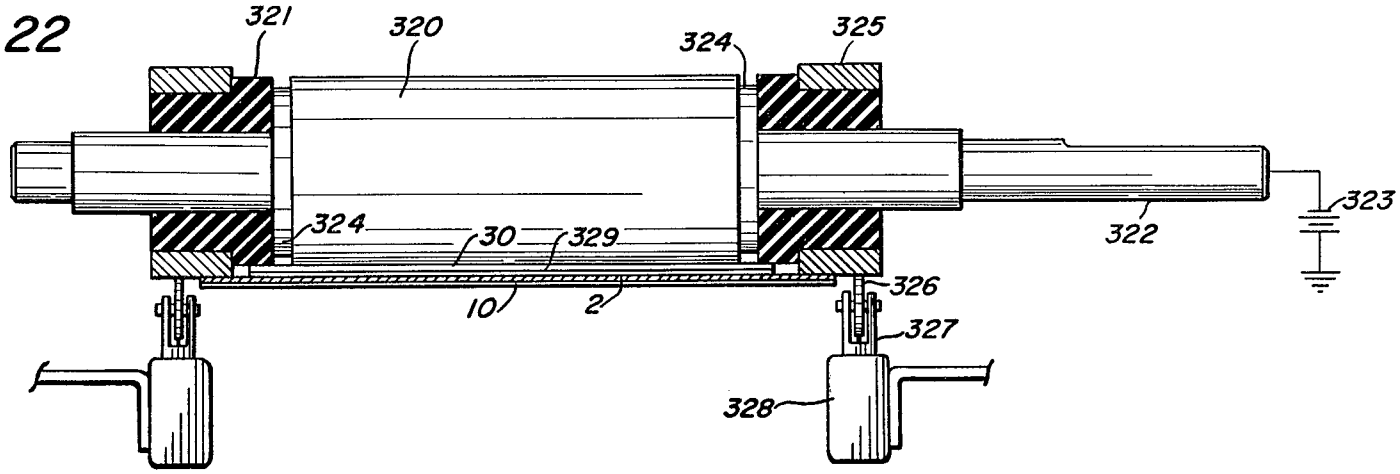
FIG. 22 shows and elevation, partially sectional view of the imaging roller and grounding mechanism.

Referring now to FIG. 22, there is shown an elevation, partially sectional view of the imaging roller and grounding mechanism, according to this invention. In some instances, it may be desirable to minimize the total resistance of the conductive web to ground. In this regard, the combination biasing and imaging roller 320 is utilized to shorten the path to ground to approximately ¼ inch and thereby provide an excellent ground close to the imaging zone.

The roller 320 is provided with the insulator rings 321 concentric with the roller shaft 322. The shaft 322 is coupled to the electrical potential source 323 used to supply the high imaging voltage to the image roller core. The image roller 320 is formed of a conductive material, preferably non-magnetic stainless steel. The roller is provided with the machined grooves 324. The blocking web 30 extends beyond the edges of the blocking web to the metal end sleeves 325. The conductive web surface 2 contacts the metal sleeves which are grounded by the brushes 326 mounted on the rods 327 carried within the blocks 328.

While the imaging roller 320 is shown as a roller, in some instances it may also take the form of an acruate type device formed of conductive material including conductive rubber.

THE ELECTRICAL POWER CONTROL

Figure 23:
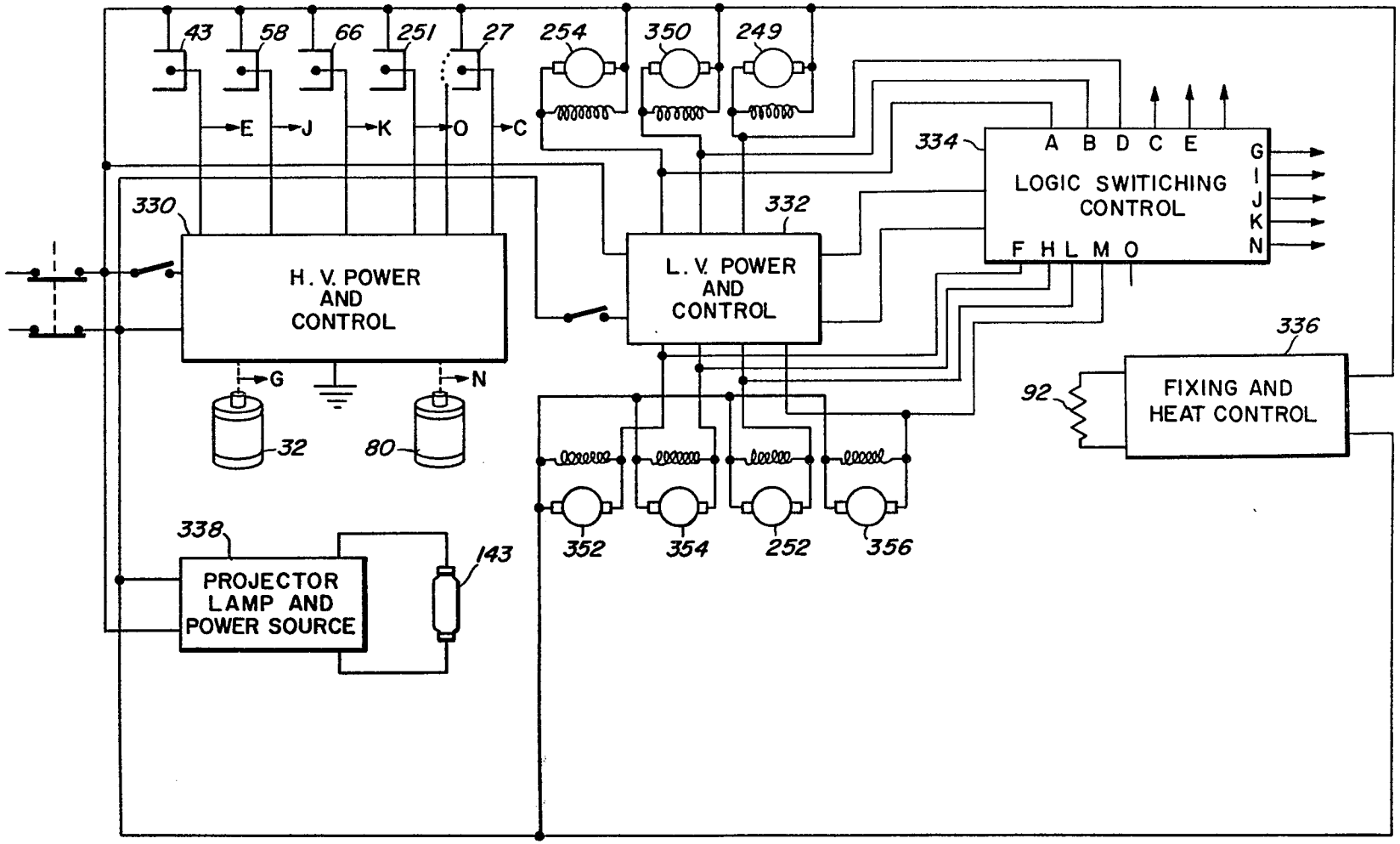
FIG. 23 shows a simplified block and partial schematic diagram of the machine electrical control system.

Referring now to FIG. 23, there is shown a simplified block and partial schematic diagram of the electrical circuit for power distribution for the photoelectrophoretic web device imaging machine.

The electrical power requirements of the photoelectrophoretic web device machine consists essentially of four types. They include the high voltage power and control 330, the low voltage power control 332, the lamp power supply 338 and the fixing and heat control power supply 336.

The high voltage power control 330 is used to supply power for the four corotrons 43, 58, 66 and 251 and the scorotron 27. The photoelectrophoretic web device machine also calls for high D.C. voltages at the imaging roller 32 and the transfer roller 80. These voltages may be produced at the common power source 330 which has a shared converter system with regulation for each output.

The low voltage power and control 332 is used to supply power for the servo motors which all require this type of power supply. The low voltage power and control 332 also supplies power for the inking motor and clutch 350, the image separator 352 and the transfer separator motor 356. The power and control 332 supplies power to the motor 252 which drives the electrostatic capstan 91 and to the scan motor 345. The low voltage power and control 332 is also used to supply power to the takeup motors 218 and 248 (see FIG. 17).

The lamp power supply 338 supplies power to the projector and lamp 143, whereas the fixing and heat control power supply 336 is used to supply power for the fixing station 92.

The process functions and events in the photoelectrophoretic machine requires precisely timed actuation in synchronization with the conductive web. The timing and actuation logic is provided by the logic and control system 334 which is powered by the low voltage and control 332. The logic functions are all accomplished by the use of a plug-in type system with power contactors A through O.

THE MECHANISM FOR INCREASING FORCE FRICTION BETWEEN WEBS

Figure 24:
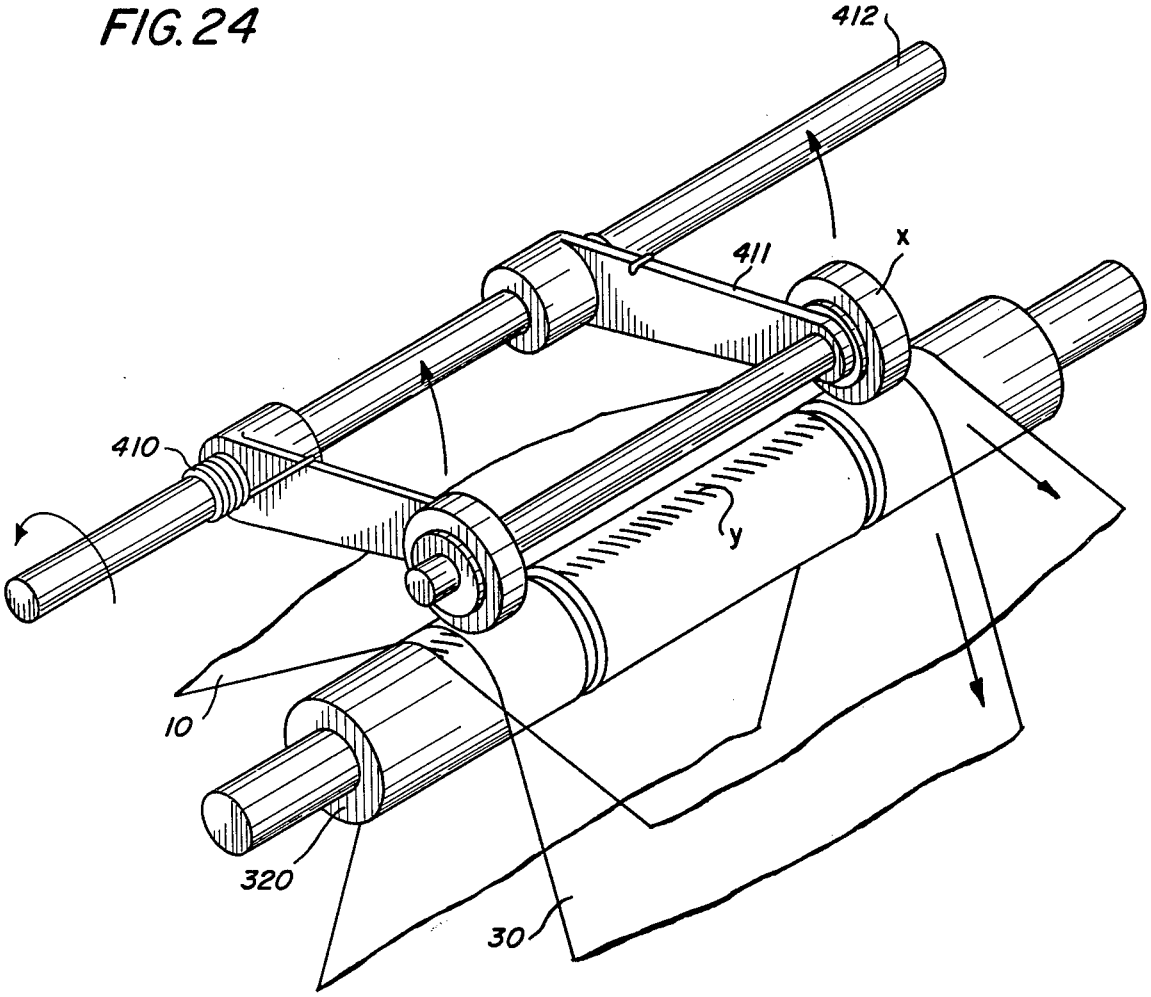
FIG. 24 is a perspective isolated view of a preferred embodiment of the method and apparatus for increasing friction force between two webs.

Referring now to FIG. 24, there is shown a perspective isolated view of the mechanism used for increasing the force friction between thin webs at the image and transfer rollers in the photoelectrophoretic web device imaging machines.

The photoelectrophoretic process is particularly sensitive to any relative motion between webs during the imaging and transfer steps. The photoelectrophoretic ink sandwiched between the webs at the imaging roller and the formed image at the transfer roller acts as a lubricant and tends to reduce the friction force between the webs to near zero. Therefore, extra web width is provided to allow for a small dry area on each side of the image or transfer zone whereat one web can exert a friction for on the other web without slip. The force, however, may be limited by the geometry of the nip and the web tension requirements of the process which control the normal force between the webs.

In order to increase the friction force at the dry area on either side of the image or transfer zone the spring loaded pressure wheels or rolls X are provided to ride against the ink-web or image-web sandwich and the roller in the dry area on either or both sides of the image or transfer zone y.

The spring 410 provides a normal force of about 5 pounds to the pressure rolls X against the web sandwich. The pressure rolls X are carried on the arms 411 that are keyed to the shaft 412. The shaft 412 rotates in the direction of the arrow in order for the pressure rolls X to be lifted in the direction of the arrows during web separation.

THE SYNCHRONOUS MOTOR DRIVE SYSTEM

Figure 25:
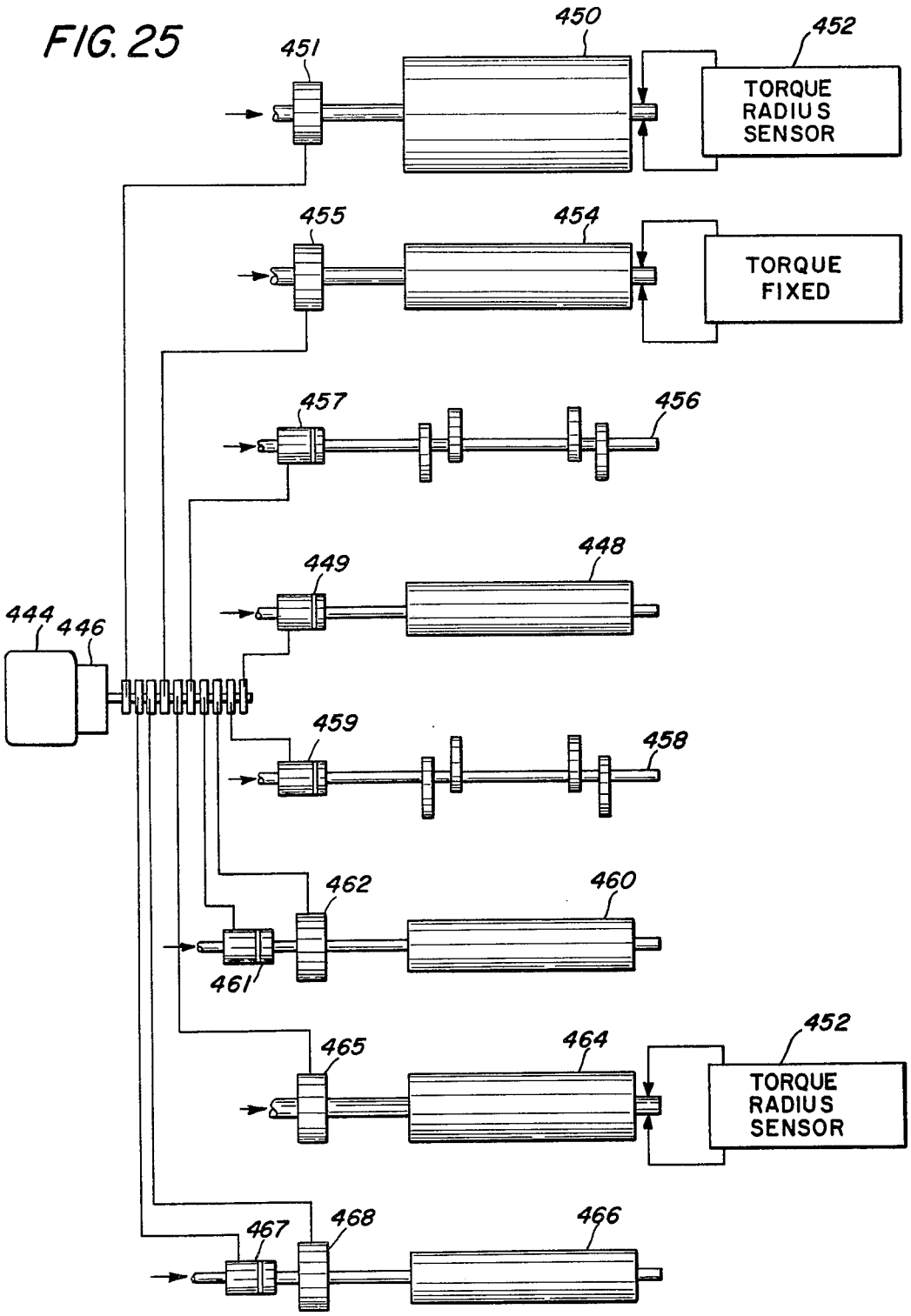
FIG. 25 is a partially schematic diagram of an alternative preferred embodiment for the photoelectrophoretic web machine synchronous motor drive system.

Referring now to the FIG. 25, there is shown a partially schematic diagram of an alternative preferred embodiment for the photoelectrophoretic web machine synchronous motor drive system. In order to further simplify the web drive system, the entire web drive system can be driven by a synchronous motor with a suitable gear box and a series of timing belts and pulleys to provide the proper speeds of the webs to synchronize the velocity of two webs at the imaging roll and at the transfer roll.

The synchronous motor 444 with a gear box 446 drives the conductive and blocking the web takeup rolls 450 and 464 and the conductive takeup capstan 454 through overdriven clutches 451, 464 and 455 respectively. The overdriven clutches 451, 465 and 455 may be hysteresis or magnetic particle clutches which can provide variable torque. The torque on the conductive web takeup roll 450 and the blocking web takeup roll 464 may be controlled by radius sensors 452 riding on the takeup rolls, whereas the torque on the conductive web takeup capstan 454 will be fixed. The synchronous motor 444 also drives the inker cam shaft 456 and the web separator cam shaft 458 through single or half revolution clutches 457 and 459 respectively. The conductive web drive capstan 448 is driven at constant velocity through the electromagnetic clutch 449 throughout the machine cycle and will control the velocity of the webs.

The blocking web drive capstan 460 and the transfer drive capstan 466 may be driven in two ways. First, a constant torque may be supplied through overdriven clutches 462 and 468 such as the hysteresis or magnetic particle types. This torque is adjusted to provide a balanced tension in the blocking web and transfer web. During the imaging step, the blocking web is driven by the conductive web through contact at the imaging roller and during the transfer step, the paper web is driven by the conductive web through contact at the transfer roller. Secondly, during web separation, between the imaging or transfer steps, the blocking and paper webs are driven at constant speed by the motor 444 and gear box 446 through the electromagnetic clutches 461 and 467 attached to the blocking and transfer drive capstans 460 and 466 respectively. The electromagnetic clutches 461 and 467 are engaged in the machine cycle, as the conductive and blocking or conductive and paper webs separate. Conversely, the electromagnetic clutches 461 and 467 are disengaged during the imaging or transfer step and the webs are in contact at the imaging or transfer roller. Since the tension is closely balanced in the webs, the load changes very little on the motor 444 when the electromagnetic clutches are engaged.

It will also be appreciated that it is also possible to drive a document or slide projector scan system with the synchronous drive motor 444 and gear box 446 in a similar fashion.

Thus, this synchronous drive system permits two or more webs to be driven by a common motor 444 (and gear box 446) independently at nearly matched velocities when separated. When the webs are brought in contact during imaging or transfer, the conductive web drives the blocking or transfer web without relative motion between the two webs through friction contact. The synchronous motor 444 and gear box 446 also provide a tensioning drive control for each web and enables auxillary driver functions such as the projector drive scan.

IN OPERATION

The sequence of operation of the web device photoelectrophoretic imaging machine is as follows:

At standby, the conductive web supply roll, adequate for the desired copies to be made, is provided. The conductive web supply roll is braked by the adjustable hysteresis brakes at constant torque supplying low tension in the web coming off the supply roll. The blocking web supply, adequate for the desired copies to be made, is provided. The blocking web supply roll is also provided with hysteresis brakes (controlled by radius sensors for maintaining tension in the same manner as for the conductive web). The transfer or paper web supply roll, sufficient for the desired number of copies, is provided. The paper supply roll is also braked by hysteresis brakes.

The conductive web is driven at constant speed by the capstan drive roller driven by the torque motor. The conductive web takeup roller is driven by a torque motor for variable torque at the takeup roller. Alternatively, the conductive web takeup roller may be replaced by the electrostatic capstan driven by a torque motor for constant torque output. The blocking web takeup roller is driven in the same manner as the conductive web takeup to maintain a constant tension level. The paper web drive is an electrostatic capstan which supplies tension to the web via electrostatic tacking. Tension on the paper web varies as the supply roll diameter varies.

When the power is turned on initially, power is supplied to the torque motors driving the three web takeups and tension is applied to the webs. At the start of the photoelectrophoretic imaging process, the conductive web is accelerated to the desired imaging velocity. The inker starts applying the ink film to the conductive web surface at the desired ink film thickness and length. When the conductive web reaches the precharge station, the deposition scorotron applies the precharge voltage to the ink layer. The amount of potential to be applied by the scorotron will depend upon the characteristics of the photoelectrophoretic ink used in the system. When photoelectrophoretic imaging suspension of particular properties are used, the scorotron applies a high charge resulting in total pigment deposition. When photoelectrophoretic ink having other properties is used, a slightly lower charge is applied by the scorotron and will not result in total pigment deposition.

Before the ink film reaches the imaging station, the blocking web drive motor (by cam switch timing) is switched to speed mode and accelerates the blocking web to match the velocity of the injecting web. The blocking web is subjected to the corotron high voltage just prior to entering the imaging zone to assure against stray fields. As the lead edge of the ink film carried on the injecting web approaches the imaging roller, the web separator mechanism is closed by the cam switch timing system to bring the webs into contact at the imaging roller to form the ink-web sandwich at the nip. The blocking web drive motor is switched, via a switch on the separator mechanism, back to the torque mode. The imaging voltage is then applied to the imaging roller as the ink film passes over the imaging roller while the scanning optical image, from either the transparency or opaque optical input system, is projected to the imaging zone. The imaging voltage may be ramped by programming means to allow the voltage to be raised up to the desired operating level while the imaging entrance nip is being filled with liquids.

The main drive capstan roller drives the conductive web through friction contact at the desired web velocity. The friction capstan is driven by the D.C. servomotor that also drives the scan for both the opaque and transparency optics and the cam switch timing system. During the time the webs are in contact at the nip, the blocking web is driven by the conductive web through friction force between the webs. After the image is formed, the conductive web is separated from the blocking web and the blocking web drive returns to the speed mode until the next ink film approaches the imaging roller or a cam switch signals it back to the torque mode at the end of the cycle and the web stops. During the period when the webs are separated out of contact, the liquid bead buildup at the entrance nip is passed through the imaging zone by the conductive web.

The cam switch timing system operates to allow concurrent photoelectrophoretic process steps of inking, imaging and transfer. When the imaging process step for an ink film is being completed, the next successive ink film is applied to the conductive web.

After the imaging step and development takes place, the pigment on the conductive web may be discharged and then recharged by the corotrons. Alternatively, depending upon the characteristics of the ink is used, the discharge step may be omitted and the ink film is recharged only. When the leading edge of the photoelectrophoretic image on the conductive web approaches the transfer zone, the paper web drive motor is switched to speed mode by the cam switch timing to accelerate the paper web to a velocity to closely match the conductive web velocity. The transfer engaging mechanism is actuated by a cam switch to bring the conductive web into contact with the paper web at the transfer roller and a switch on the transfer separator mechanism returns the paper drive motor to torque mode.

When the transfer step is being completed, the next successive ink film is being imaged and concurrently therewith, another ink film is being applied to the conductive web. Concurrent operation of the photoelectrophoretic process steps results in the saving of web materials to reduce cost and improve machine thruput.

Prior to the transfer step, the fluid injecting device provided at the transfer zone entrance, is used to apply an air breakdown medium to the deposited image in order to eliminate air breakdown defects. A fluid injecting device may also be provided at the entrance nip to the imaging zone and the air breakdown reducing medium is applied to the entrance nip prior to the imaging step.

During the time that transfer takes place, the paper web drive motor remains in torque mode and the conductive web drives the paper web through friction contact at the transfer nip. When the transfer step is completed, the transfer separator mechanism is actuated by the cam switch timing system, and the paper drive motor is switched back to speed mode. The conductive and the paper webs separate briefly. This will allow liquid bead that may accumulate at the entrance nip to pass out of the transfer zone.

The transferred image on the paper web is transported to the fixing station to fuse the image and to the paper receiving chute. A trimming station may be providing to trim the copy to the desired size. The conductive and blocking webs are driven by drive capstans onto the flanged rewind spools. The rewind spools are removable and are driven by separate drive motors. The torque outputs for the motors for the rewind spools are controlled by feedback from radius sensors.

The conductive web rewind spool may be replaced by the electrostatic capstan for use when saving or examining the image on the conductive web. The conductive web electrostatic capstan is driven by a torque motor set at constant torque sufficient to overcome friction of the system and accelerate the web. The conductive surface of the web is grounded and a pulse voltage applied to the capstan roller to tack the web to the roller.

The above sequence steps are repeated for multiple copies. At the start of the last copy, after the last required ink film is applied, the machine logic control disables the inker until a new run is initiated. After the last copy is imaged, the separator mechanism remains open in standby and the blocking web drive stops. After the last transfer, the transfer operator moves the transfer engaging roller to standby separating the conductive and paper web. As the residual image, if any, on the conductive web exits the transfer roller, the conductive web is stopped. The paper web continues in speed mode until the transferred image is out of the machine and a time delay relay switches the paper drive motor back to torque mode, stopping the paper web.

In the alternative machine embodiment, the photoelectrophoretic process steps of inking, deposition, imaging and transfer are separate and distinct in time occurrence. First, the conductive web is inked and the inked web is transported to the imaging zone. The ink film is subjected to the deposition step and passed to the imaging zone for imaging. The image formed on the conductive web is discharged and recharged, or alternatively, recharged only prior to transfer. The fluid injecting device provided at the imaging nip entrance and the transfer nip entrance may be used to apply an air breakdown reducing medium into the imaging and transfer nips before imaging and transfer. When the transfer process step is completed, the next successive ink film is applied to the conductive web, and the foregoing sequence steps are repeated for multiple copies.

Other modifications of the above-described invention will become apparent to those skilled in the art and are intended to be incorporated herein.

What is claimed is:

1. Photoelectrophoretic imaging apparatus comprising:

a. means for supporting a first transparent web electrode for travel;

b. first drive means cooperating with said means for supporting a first transparent web electrode to advance a first transparent web electrode through a predetermined path passing an ink coating means and an imaging station;

c. ink coating means for applying a thin film of photoelectrophoretic ink to the first transparent web electrode;

d. means for supporting a second web electrode for travel;

e. second drive means cooperating with said means for supporting a second web electrode to advance the second web electrode through a predetermined path passing the imaging station;

f. an imaging roller mounted at the imaging station, the second web electrode advanced into contact therewith; and whereat the ink carrying surface of the advancing first transparent web electrode is advanced by (a) and (b) into contact with the advancing second web electrode while it is contacting said imaging roller, thereby forming an ink-web sandwich and an imaging zone nip at said imaging roller, the two webs having ink sandwiched between them, supported at the imaging zone nip by said imaging roller on the second web electrode side of the sandwich without a support member contacting the imaging zone area on the first transparent web electrode side of the sandwich at the imaging zone nip;

g. means for coupling a voltage source to the imaging roller to establish an electric field across the ink-web sandwich at the imaging zone nip;

h. exposure means for projecting an image pattern of activating electromagnetic radiation through the first transparent web electrode onto the ink-web sandwich at said imaging roller;

i. means for separating the two webs from contact after the two webs have been advanced past the imaging station and said imaging roller to form an image pattern corresponding to the activating electromagnetic radiation on at least one of the webs; and k. cycling means for timing application of a next successive film of photoelectrophoretic ink onto the first transparent web electrode concurrently with completion of image formation in (i) above.

2. The apparatus according to claim 1 wherein the means for supporting a first transparent web electrode includes supply and takeup rolls.

3. The apparatus according to claim 2 wherein the means for supporting a second web electrode includes supply and takeup rolls.

4. The apparatus according to claim 3 wherein the supported first transparent web electrode is an injecting electrode.

5. The apparatus according to claim 4 wherein the supported second web electrode is a blocking electrode.

6. The apparatus according to claim 5 wherein the supported first transparent web electrode and the supported second web electrode are consumable.

7. The apparatus according to claim 1 wherein the image formed on at least one of the webs is a positive photoelectrophoretic image formed on the first transparent web electrode.

8. The apparatus according to claim 1 further comprising in combination:

a. means for supporting a third paper transfer web for travel;

b. third drive means cooperating with said means for supporting a third paper transfer web to advance the third paper transfer web through a predetermined path passing a transfer station;

c. a transfer roller mounted at the transfer station, the third paper transfer web advanced into contact therewith; and whereat the formed image carrying surface on at least one of the advancing web electrodes is advanced by (a) and (b) into contact with the advancing third paper transfer web while it is contacting said transfer roller thereby forming an image-web sandwich and a transfer zone nip at said transfer roller, the two webs having an image sandwiched between them, supported at the transfer zone nip by said transfer roller on the third paper transfer web side of the sandwich without a support member contacting the transfer zone area on the first transparent web electrode side of the sandwich at the transfer zone nip;

d. means for coupling a voltage source to the transfer roller to establish an electric field across the image-web sandwich at the transfer zone nip;

e. means for separating the two webs from contact after the two webs have been advanced past the transfer station and said transfer roller support thereby providing a copy of the image on the third paper transfer web; and f. cycling means for timing application of a next successive film of photoelectrophoretic ink onto the first transparent web electrode and completion of image formation concurrently with completion of transfer in (e) above.

9. The apparatus according to claim 8 further including means for fixing the copy on the third paper transfer web.

10. The apparatus according to claim 9 further including means for cutting the copy on the third paper transfer web to a desired format size.

* * * * *